United States Patent [19]

Burton et al.

[11] 4,339,118

[45] Jul. 13, 1982

[54] CLOTH SPREADING METHOD AND APPARATUS

[75] Inventors: James O. Burton, Brunswick; Christopher J. Dannels, Lakewood; Frank J. Ahlin, Willoughby Hills, all of Ohio

[73] Assignee: The Richman Brothers Company, Cleveland, Ohio

[21] Appl. No.: 109,099

[22] Filed: Jan. 2, 1980

[51] Int. Cl.[3] ..... B65H 29/46

[52] U.S. Cl. ..... 270/31

[58] Field of Search ..... 270/30-31; 83/925 CC

[56] References Cited

U.S. PATENT DOCUMENTS

| | | | |
|---|---|---|---|
| Re. 27,538 | 12/1972 | Martin | 270/31 |
| Re. 28,148 | 9/1974 | Benson | 270/31 |
| 1,259,487 | 3/1918 | Campbell | 270/31 |
| 3,033,561 | 5/1962 | Hanna | 270/31 |
| 3,081,660 | 3/1963 | Parrish | 270/31 |
| 3,112,107 | 11/1963 | Theodosion | 270/31 |
| 3,227,390 | 1/1966 | Wendelken | 270/31 |
| 3,400,927 | 9/1968 | Martin | 270/31 |
| 3,479,023 | 11/1969 | Martin | 270/31 |
| 3,663,006 | 5/1972 | Benson | 270/31 |
| 3,684,273 | 8/1972 | Benson | 270/31 |
| 3,701,299 | 10/1972 | Stumpf | 83/925 CC |
| 3,727,907 | 4/1973 | Martin | 270/31 |
| 3,755,861 | 9/1973 | Castro | 242/62 |
| 3,779,541 | 12/1973 | Stumpf | 270/31 |
| 3,782,649 | 1/1974 | Frederick | 242/67.2 |
| 3,784,184 | 1/1974 | Stumpf | 270/31 |
| 3,901,590 | 8/1975 | Ashida | 242/183 |
| 4,082,258 | 4/1978 | Smith | 270/31 |
| 4,183,514 | 1/1980 | Off | 270/31 |

*Primary Examiner*—Edgar S. Burr
*Assistant Examiner*—A. Heinz
*Attorney, Agent, or Firm*—Watts, Hoffmann, Fisher & Heinke Co.

[57] ABSTRACT

A cloth spreading apparatus for use with an automatic cloth cutting machine. The apparatus is used in conjunction with a movable cutting surface which conveys cloth to a cutting station. The apparatus includes a spreader frame which moves on rollers along track surfaces adjacent the cloth laying surface to deposit cloth on the stationary surface. To provide this movement the spreader includes a direct current motor with an output coupled to the rollers. The motor speed of rotation is monitored by control circuitry including a tachometer.

Mounted to the spreader is a cloth feed carriage which includes a cloth feed motor. The relative speed of the drive motor and cloth feed motor are controlled by feedback circuitry coupled to a drive and feed tachometer. The angle of cloth deposition onto the cutting surface is monitored by a feeler gauge. Whenever this angle deviates from an optimum value the speed of the cloth feed motor is automatically adjusted by circuitry coupled to the cloth roll motor. In this way, tension of the cloth is optimized as it is dispensed onto the surface.

10 Claims, 20 Drawing Figures

PRINTED CIRCUIT CARD NO. 1

CLOTH SPREADING METHOD AND APPARATUS

BACKGROUND OF THE INVENTION

The present invention relates generally to cloth spreading machines and in particular to a method and apparatus for spreading cloth in a uniform manner on a cutting surface.

Cloth spreading machines are widely used in the garment industry and are generally employed to deposit a layer or layers of cloth on a cutting surface. One type of prior art spreader is mounted above a stationary cutting table and is adapted to travel reciprocally above the table, dispensing a layer of cloth from a cloth supply spindle, as it traverses the length of the table. If multiple layers of cloth are to be laid, the spreader will either return to its starting position and dispense another layer of cloth on the table or alternately, a second layer will be deposited during the return travel of the spreader.

Many of the prior spreaders, include sensors for monitoring the tension in the cloth web. These sensors attempt to control the rate of cloth feed so that the cloth is spread onto the cutting surface uniformly at a predetermined tension, or "tension free".

In some prior art spreaders, a sensor in the form of a dancer roll is used to monitor cloth tension. The dancer roll is generally pivotally mounted and interposed in the web path so that changes in web tension will cause positional changes in the dancer roll. In one spreader, the dancer roll is operatively connected to a switch that controls the cloth drive; and in another spreader, the dancer roll is connected to a potentiometer which modifies the speed of the cloth drive.

Because most dancer rolls are spring biased, a predetermined tension in the web is necessary to overcome the dancer roll force and move it to an equilibrium position. In machines that use dancer rolls, it is difficult, if not impossible, to deposit a uniform layer of cloth on a cutting table, substantially "tension free", for the dancer roll itself will produce some tension in the web.

Other sensors have been suggested which do not contribute to the web tension. These include loop sensors which monitor the droop or sag in the web at a predetermined location. In one suggested spreader, the droop in the web is sensed optically whereas in another spreader, the droop is monitored by a radiant energy sensor. These sensing devices have not been totally satisfactory and in the case of the radiant energy sensor, have been rather expensive.

A variation in tension along the width of the cloth web is often encountered. Most prior art spreaders do not address this problem, but merely monitor the tension at one position on the web and adjust the cloth feed rate accordingly. Compensation for tension variation across the web is ignored. In the case of patterned fabric, specifically plaids, a variation in tension will skew the orientation of the cloth with respect to the cutting surface and a pattern mismatch will result when the garment is assembled.

With the advent of automatic cutting machines, new problems arise and the old problems are compounded. One type of automatic cutting machine is a laser cutter which includes a computer controlled laser head that directs a minute laser beam over a ply of cloth on a cutting surface and cuts out individual garment pieces while simultaneously fusing the edges. The cutting surface is a honey combed conveyor that extends to either side of the laser cutting station. A ply of cloth is laid upon the loading side of the conveyor surface and is then advanced into the cutting station. The cut pieces and the remnants are transported by the conveyor out of the cutting station to an unloading area.

Spreaders adapted for automatic cutting systems have been proposed. For the laser cutting system described above, a spreader has been proposed which is positioned at the input end of the conveyor and includes a cloth feed roll, an associated drive motor and an optical loop sensor for maintaining a predetermined tension in the web as it is deposited on the conveyor. In the suggested spreader, the cloth feed drive is controlled by the laser cutting machine and dispenses cloth onto the conveyor as it advances toward the cutting station. Because the conveyor speed is quite high, the cloth feed must accelerate quickly to match the speed of the conveyor. Any lag in the cloth feed mechanism will be manifested as an area of excessive tension or stretch in the cloth layer. Garment pieces cut from these stretched areas will not be dimensionally stable. The problem is further aggravated with pattern fabrics, especially plaids, for any nonuniformity is reflected in stripe or pattern skewing. In practice, it has been found that this spreader could not be made to spread cloth consistently on a high speed laser cutting system.

Another problem associated with this and other prior suggested spreaders is the inability of the operator adequately to inspect the cloth prior to advancing into the cutting station to insure that it has been spread uniformly. Moreover, even if the operator observes nonuniformity, no provision for rewinding the cloth onto the spreader is provided so that it can be re-spread.

Finally, it is quite common for remnants to remain on, and by adhered to, the cutting surface after leaving the unloading station. These remnants should be removed because the presence of one will cause distortions in subsequent spreading and cutting operations. Because the prior suggested spreaders are mounted at the input end of the conveyor, it is virtually impossible for the operator to inspect the conveyor prior to cloth spreading, and as a consequence, it is difficult to be certain that all remnants have been removed.

SUMMARY OF THE INVENTION

The present invention provides a new and improved method and apparatus for spreading a uniform layer of cloth, substantially tension free, on a cutting surface, which facilitates and enhances the overall operation of an automatic garment cutting system.

According to a preferred embodiment, the disclosed cloth spreading machine includes a spreader frame, and a spreader drive for moving the frame longitudinally with respect to a cutting surface. A cloth feed carriage is mounted to the frame and supports a cloth feed mechanism that includes a drive motor for controlling the speed of a cloth feed roll. A negative feedback arrangement controls a spreader drive motor and the cloth feed drive motor so that the rate at which cloth is fed from the carriage is proportional to the spreader drive speed.

An angularity control is electrically coupled to the negative feedback arrangement and monitors the angle at which the cloth is deposited on the cutting surface. Preferably, the angularity control is operative to modify the speed of the cloth feed drive motor to compensate for changes in the angle of cloth incidence with the cutting surface.

This method and apparatus for controlling the cloth feed is an important feature of the invention and provides significant advantages over the prior art. Sensing cloth angle rather than cloth tension results in more consistent cloth spreading. Unlike tension sensing devices, i.e. dancer rollers, used in prior spreaders, the angle detector disclosed by the present invention does not add to web tension. More importantly, the construction of the control is no more expensive than dancer rollers and thus is more cost effective than non-contact type sensors such as radiant energy detectors.

In accordance with this feature of the invention, the angularity control preferably comprises a low torque potentiometer and an actuating arm which extends into the cloth feed path intermediate the cloth feed roll and the cutting surface. The cloth web is frictionally engaged by the cloth feed roll and is pulled from a supply roll. From the feed roll, the cloth descends downwardly to the cutting surface, contacting and displacing the actuating arm of the angularity control prior to impinging on the cutting surface. The speed at which the spreader travels over the surface relative to the cloth feed rate will determine the angle of incidence between the cloth and the cutting surface. When the feed rate and spreader speed are matched, the cloth angle will be substantially 90° and the cloth will be deposited substantially tension free. When the spreader speed is greater than the cloth feed rate, an acute angle of incidence will result and the cloth will be deposited on the cutting surface at a predetermined tension, the tension being a function of the angle formed.

According to another feature of the invention, an articulated tension guide or barrier extends across the spreader and is disposed just above the cutting surface and adjacent the angularity control arm. The cloth web passes between the guide and the arm. The guide preferably comprises a series of vertically aligned, horizontally oriented rods suspended by a flexible cable or chain. The guide is operative to restrain portions of the web when cloth of non-uniform tension is being spread. Under these circumstances, the angularity control is adjusted so that the portions of the web having excess tension contact the guide to effect a localized stretching of the cloth so that wrinkling is avoided in the slack areas of the web.

According to still another feature of the invention, an apparatus and method is disclosed for operating a cloth spreader in connection with a moveable cutting surface or conveyor that normally forms a part of an automatic garment cutting system. The disclosed method and apparatus includes longitudinal guideways along the conveyor defining track surfaces for supporting the spreader above the conveyor. The spreader includes a plurality of drive and driven rollers riding in the guideway and a spreader drive engageable with the drive rollers for effecting movement in the spreader above the conveyor. The spreader includes a conveyor engaging device for coupling the spreader to the conveyor so that the spreader is advanced to a predetermined location when the conveyor moves towards the cutting station. After the spreader has been advanced, the conveyor engaging mechanism is released and the spreader drive is energized. The spreader then returns to its starting position depositing a layer of cloth to be cut on the stationary conveyor as it traverses.

Unlike prior suggested spreaders, the present invention obviates the need for matching cloth feed rates and conveyor speed. Because the cloth is deposited on the conveyor when it is stationary, the feed rate is not critical and the spreader control is greatly simplified for only the cloth feed roll speed and spreader drive speed need be controlled. Because the cloth is spread during a cutting cycle, high spreader speeds are unnecessary. Additionally, the spreader operator is afforded an opportunity to inspect the conveyor prior to spreading and the cloth prior to cutting.

Currently available automatic cutting systems such as laser cutters employ a chain drive for advancing the conveyor. Accordingly, the conveyor engaging apparatus mounted in the spreader preferably comprises at least one moveable pin mounted to the spreader frame which is driven downwardly by an actuating mechanism and enters a chain link so that movement in the chain will cause attendant movement in the spreader. After the spreader has been advanced by the conveyor chain, the pin is retracted and a drive clutch is energized which connects the spreader drive motor to the drive wheels of the spreader. To minimize slippage, the drive wheels are preferably toothed and are adapted to engage longitudinally spaced apertures in the track surfaces. As the spreader moves in relation to the conveyor and unrolls cloth onto the conveyor, cloth positioned in a cutting station is cut by a computer assisted laser cutting mechanism. At the end of the spreader return travel, the pin reengages the conveyor chain drive and the spreader drive motor is declutched so that the spreader can move freely along the track surfaces with the conveyor once cloth cutting operations have been completed.

In one embodiment of the invention there are three modes of spreader movement control. In a manual mode an operator can position the spreader in relation to the conveyor by activating a switch. The feed cloth roll may similarly be rotated to wind and unwind cloth. In so called automatic and semi-automatic modes drive and cloth deposition are coordinated by control circuitry mounted to the spreader. In the semi-automatic mode, the spreader movement is initiated by activation of a pushbutton switch. This allows the operator to monitor spreader movement until he is satisfied with its performance and then switch to the automatic mode of spreader operation.

It should be apparent that the present invention provides significant operational advantages over prior art spreaders, facilitates cloth spreading on automatic garment cutting systems, and greatly enhances the overall operation. The invention is achieved inexpensively and reliably. When used with a moveable conveyor, it obviates the need for matching conveyor and cloth feed speeds and thus eliminates the conveyor speed monitoring devices employed by the prior art.

Additional features and a fuller understanding of the invention will be obtained in reading the following detailed description made with reference to the accompanying figures.

DESCRIPTION OF THE PREFERRED EMBODIMENT

Figure 1:
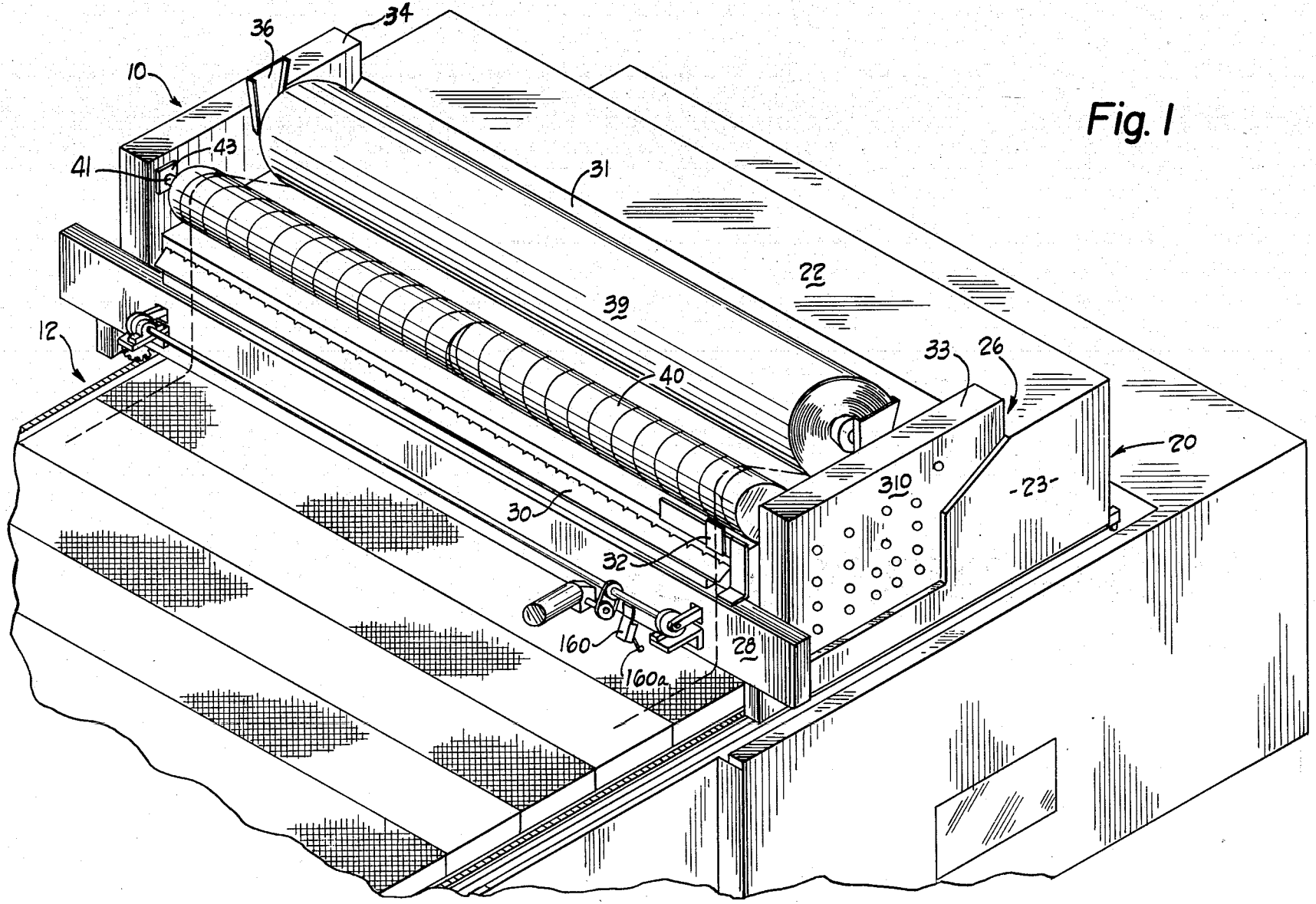
FIG. 1 illustrates a perspective view of a cloth spreader constructed in accordance with the preferred embodiment of the invention mounted above a movable cutting surface forming part of an automatic garment cutting system.
Figure 2:
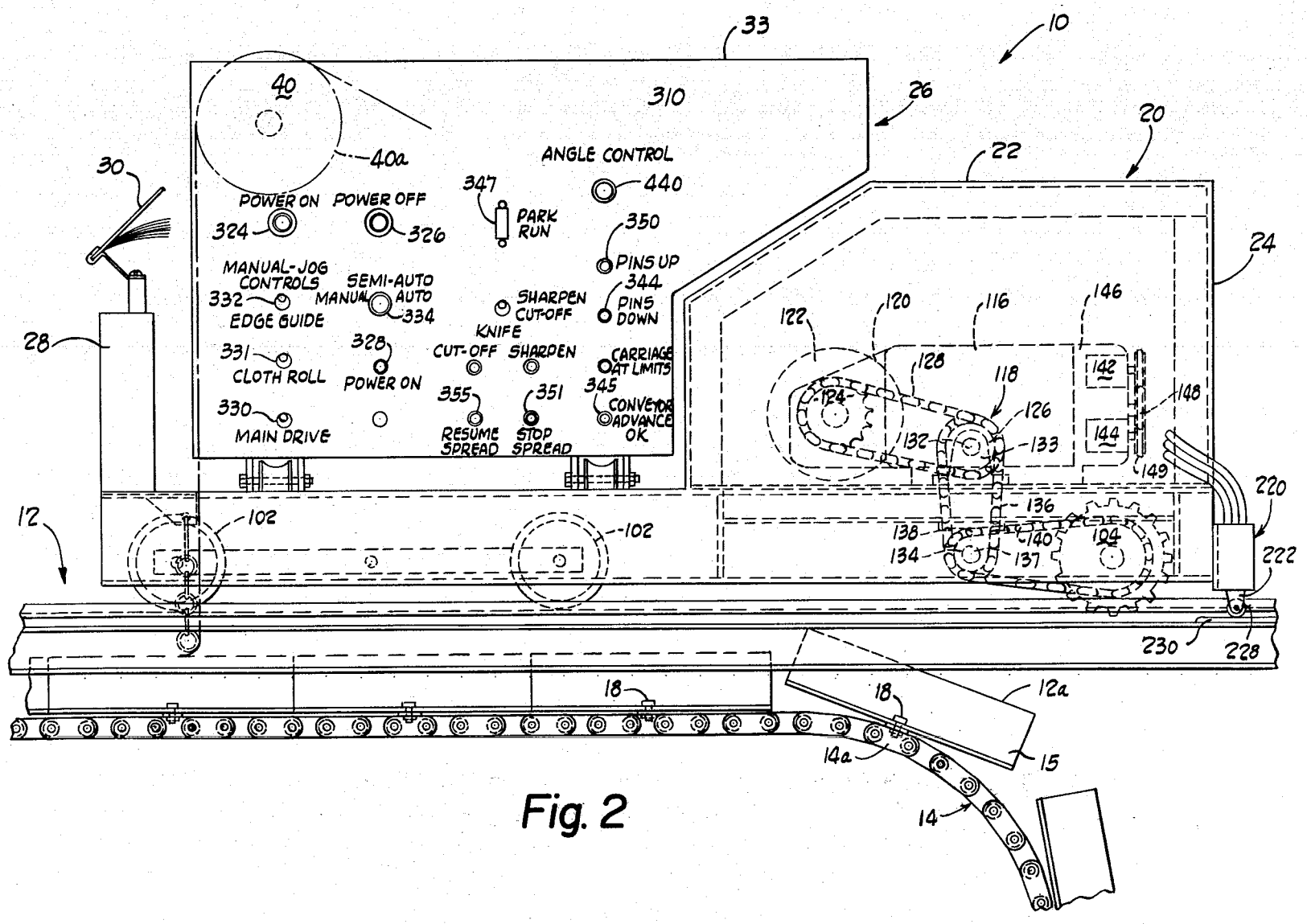
FIG. 2 is a side elevational view of the spreader and a portion of the drive system for the movable cutting surface, shown in FIG. 1.
Figure 8:
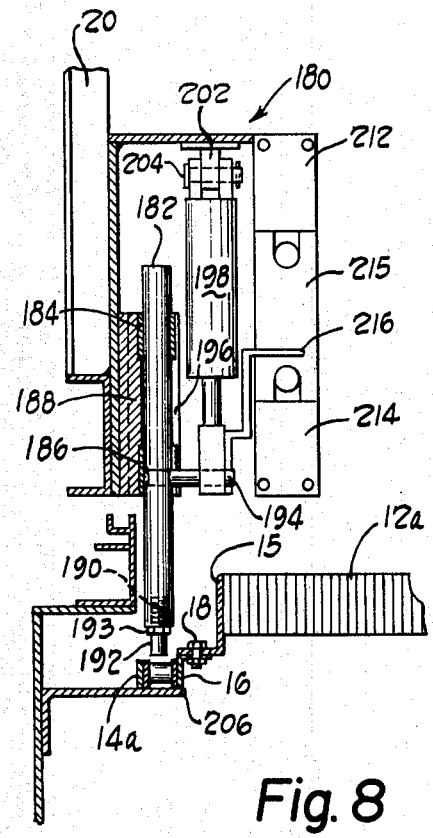
FIG. 8 is a cross-sectional view of a pinning arrangement attached to the spreader as seen along the line 8—8 in FIG. 3.

FIG. 1 illustrates the overall construction of a cloth spreader 10 embodying the present invention and mounted for movement above a longitudinally movable cutting surface or conveyor 12 forming part of an automatic garment cutting system. Referring also to FIGS. 2 and 8, the conveyor 12 comprises a series of adjacent honeycombed sections **12*a* attached to and driven by a continuous chain 14 (shown in FIG. 2). An L-shaped bracket 15 (see FIG. 8), fastened on each end of the section 12*a*, is bolted to an inverted L-shaped bracket 16 attached to a chain link 14*a*, by a threaded fastener 18. A plurality of brackets 16 are spaced along the chain 14 to form the spaced attachment points for the sections 12*a***.

Figure 5:
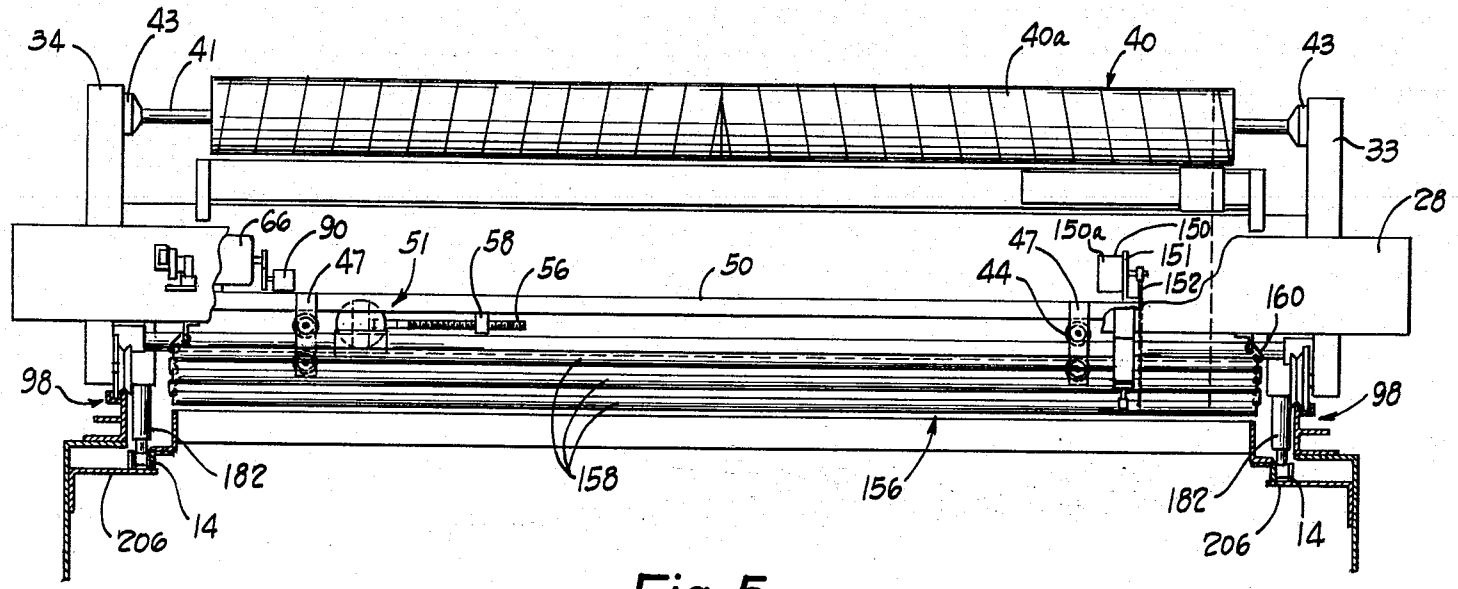
FIG. 5 is a front view of the cloth spreader shown in FIG. 1 with portions broken away to show interior construction.

The spreader 10 is operative to dispense a layer of cloth on the conveyor 12 which is then advanced into a cutting station (not shown). Referring to FIGS. 1, 2 and 5, the spreader 10 comprises a spreader support housing structure 20 and a cloth supply and feed carriage 26 which is tranversely movable with respect to the spreader support housing 20. The position of the carriage 26 is determined by an edge guide system which monitors the edge of the cloth being spread and adjusts the carriage position accordingly so that edge alignment with the cutting surface 12 is maintained.

The housing 20 is defined by top and side panels 22, 23 and a back panel 24. A conventional cloth cutoff assembly 28 is mounted to the front of the spreader support housing 20 along with a static eliminator bar 30 and an optical sensor 32 forming part of a cloth edge guide system. The cutoff assembly 28, the static bar 30 and the optical sensor 32, which are conventional, do not form part of the invention and therefore will not be expanded in greater detail.

Figure 6:
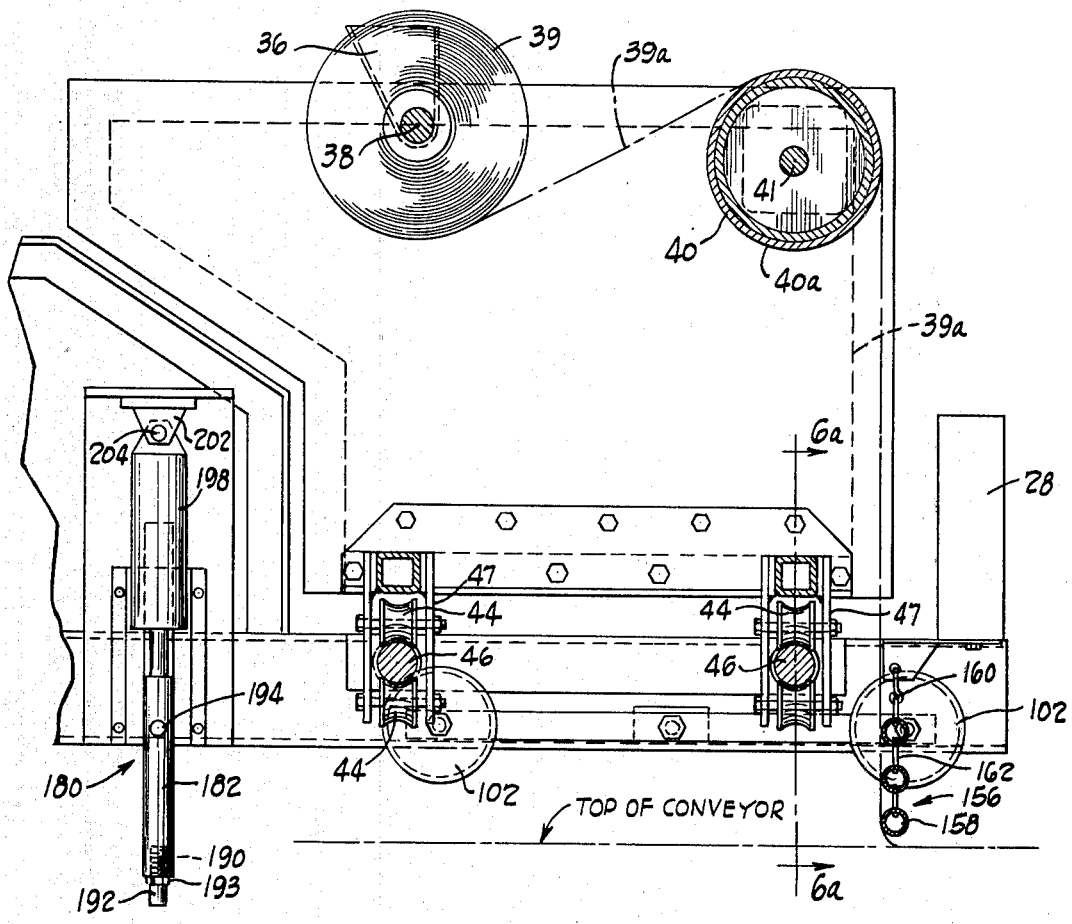
FIG. 6 is a cross-sectional view of the spreader as seen along the line 6—6 in FIG. 4.

The cloth feed carriage 26 is covered by a top panel 31 and includes metal side housings 33, 34 each having a V-shaped receptacle 36 for receiving and mounting a cloth supply spindle 38 on which a supply of fabric 39 is rolled (see also FIG. 6). A cloth feed roll 40 having a frictional outer surface **40*a* is mounted to a shaft 41 which is rotatably supported in the carriage 26 by a pair of bearing blocks 43. A feed roll drive system is operative to rotate the feed roll 40 so that cloth is pulled from the supply roll 39 at a controlled rate. A front side panel 33*a* of the housing 33** mounts a plurality of operator controls and indicator lights which will be described later in greater detail.

Figure 3:
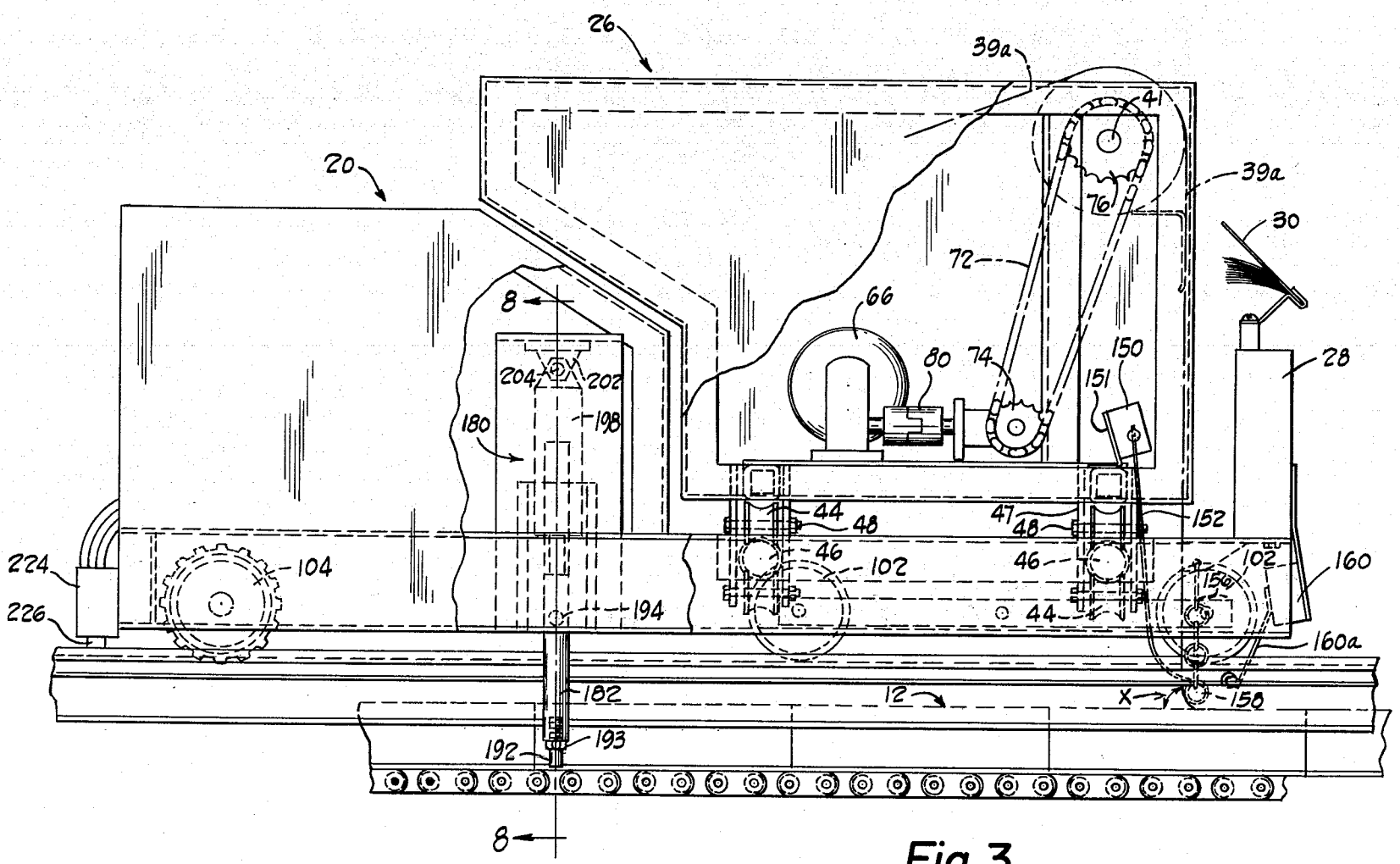
FIG. 3 is a partially sectioned side view of the spreader shown in FIG. 2.

As seen in FIGS. 3 and 5, the cloth feed carriage 26 is mounted for transverse movement with respect to the spreader housing 20 by pairs of grooved rollers 44 which engage and ride above and below a pair of transverse support rods 46 mounted in the spreader support housing 20. The rollers 44 are captured in brackets 47 by thru-bolts 48.

Figure 4:
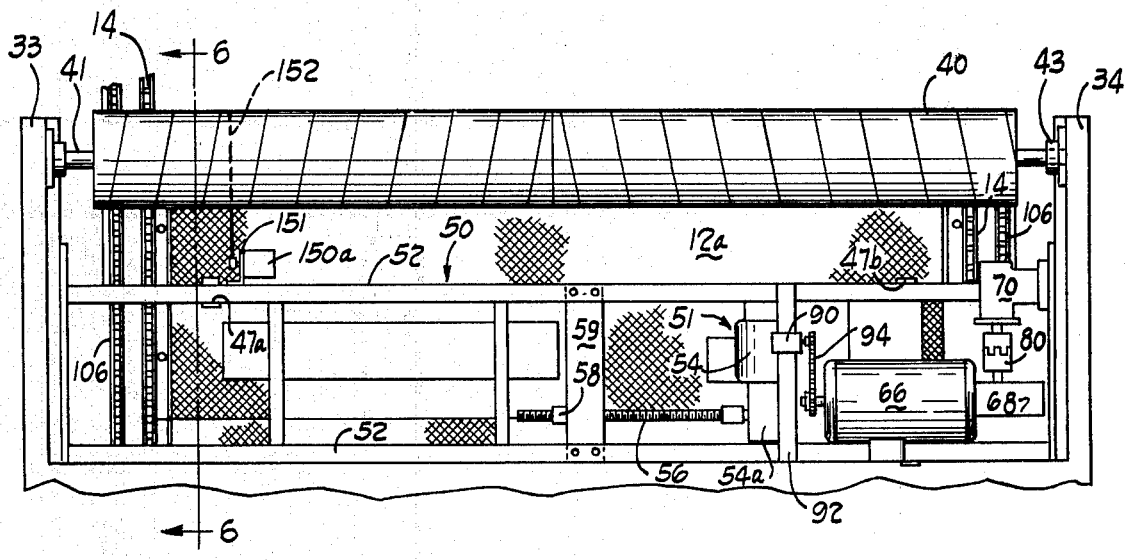
FIG. 4 is a top plan view of a cloth feed carriage with a top panel removed to show internal features.

Referring to FIG. 4 which illustrates a top view of the interior construction of the feed carriage 26, an internal ladder-type frame assembly 50 can be seen that comprises a pair of box channels 52 held in spaced relation by a plurality of cross-members and mounting plates. The roller brackets 47 are welded to the box channels 52 at spaced locations, two of which are designated by the reference characters **47*a*, 47*b*. The transverse support rods 46 that are engaged by the rollers 44 are disposed immediately below the box channels 52**, as viewed in FIG. 4.

The position of the cloth carriage 26 relative to the spreader support housing 20 is determined by a carriage drive 51 shown in FIGS. 4 and 5 which forms a part of the conventional edge guide system. The drive 50 includes a reversible motor 54 mounted to the spreader support housing just below the carriage frame 50. The motor 54 when energized, rotates a threaded shaft 56 through a right angle drive **54*a* integral with the motor 54. The threaded shaft 56 threadedly engages a threaded bushing 58 mounted to a cross-member 59 which forms a part of the internal carriage frame, 50. Rotation of the shaft 56 will effect movement in the feed roll carriage to the left or the right, with respect to the spreader housing 20 as viewed in FIG. 4, depending on the direction of rotation. The rotation of the motor 54 and hence the position of the carriage 26 relative to the spreader housing 20**, is controlled by the conventional edge guide sensor and associated circuitry.

The cloth feed roll drive, as best depicted in FIGS. 3 and 4, comprises a DC drive motor 66 that is mechanically coupled to the feed roll 40 through a pair of right angle drives 68, 70 and a continuous chain 72. The chain 72 couples an output sprocket 74 of the right angle drive 70 to a feed roll sprocket 76 fastened to one end of the feed roll shaft 41. A resilient coupling 80 interconnects the right angle drives 68, 70. The drive motor 66 and right angle drives 68, 70 are mounted to the carriage frame assembly 50 and thus move with the carriage, relative to the spreader support housing 20. The chain 72 that couples sprocket 74 and 76 is enclosed by the side housing 34 and thus is shielded from the operator.

A tachometer/generator (tach/gen) 90 is mounted to a cross-member 92 of the carriage frame 50 and is driven by the motor 66 through an O-ring belt 94. The tachometer/generator 90 monitors the speed of the motor 66 and is a part of a motor speed control circuit that will be explained later.

Figure 7:
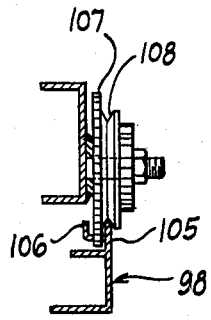
FIG. 7 illustrates the construction of a spreader drive wheel.

The spreader 10 includes its own drive system for moving the spreader along the cutting surface or conveyor 12. In the preferred embodiment, the spreader 10 is guided along a predetermined path by guides or trackways 98 mounted on either side of the conveyor 12 (see FIG. 5). A plurality of drive and driven wheels are mounted at spaced locations along the bottom of the spreader support housing 20. The driven wheels are designated by the reference character 102 while the drive wheels are designated by the reference character 104. As shown in detail in FIG. 7, the trackway 98 includes an upstanding plate portion 105 and an apertured track 106 that extends from the side of the plate portion 105.

The drive wheels 104 include sprocketed and V-shaped pulley-like portions 107, 108, respectively. The sprocketed portion 107 is adapted to engage the apertured track 106 and thereby obviates drive wheel slippage. The V-shaped pulley-like section 108 rides on the top edge of the vertically standing plate portion 105. The driven wheels 102 are shaped like the V-shaped portion 108 of the drive pulley 106 and also ride on the vertically standing plate portion 105 (see FIG. 6*a*). The engagements between the plate 105 and the V-shaped wheels 102, 104, fixes the lateral position of the spreader support housing 20 relative to the conveyor 12.

Referring to FIG. 2, the drive wheels 104 are driven by a DC motor 116 through a chain/sprocket transmission indicated generally by the reference character 118. Motor torque is transferred to the drive sprockets 104 through an integral right angle drive 120 that is coupled to the transmission 118 by an electromagnetic clutch 122. The clutch 122 is energized to effect spreader travel during a spread cycle.

The chain/sprocket transmission 118 comprises cascaded pairs of sprockets and associated chains. Specifically, a sprocket 124 is driven by the clutch 122 (when energized) and in turn drives a sprocket 126 by a chain 128. A smaller sprocket mounted behind the sprocket 126 is driven by the sprocket 126 through a common shaft 132. The shaft 132 is rotatably supported by a pair of pillow blocks, one of which is designated by the reference character 133 in FIG. 2. This smaller sprocket, which is hidden from view in FIG. 2 by the sprocket 126, drives a sprocket 134 through a chain 136. The sprocket 134 is attached to an elongate drive shaft 137 that extends transversely along the spreader support frame. The drive shaft 137 is coupled to each of the drive wheels 104 by a sprocket and chain 138, 140 mounted on the drive shaft.

A pair of tachometer/generators 142, 144 is mounted to a bracket 146 and are driven by an output pulley 148 of the drive motor 116 through an O-ring belt 149. The tach/generators 142, 144 are part of a negative feedback control circuit that coordinates the speed of the cloth feed and spreader drive motors 66, 116 so that the cloth is deposited uniformly and at a predetermined tension on the conveyor 12. The control circuitry will be explained in greater detail further on.

In operation, the spreader 10 moves along the conveyor 12 and deposits a layer of cloth to be cut. The cloth is fed from the cloth feed carriage by the cloth feed roll 40 which rotates and pulls cloths from the cloth supply spindle at a rate proportional to spreader speed. Referring to FIGS. 3 and 6, the path of travel of the cloth web 39*a* is shown. As mentioned above, the fabric is pulled from the cloth supply 39 by the feed roll 40. From the feed roll 40, the web 39*a* descends downwardly, passing between an angularity control 150 and a tension guide or barrier 156 just prior to contacting the cutting surface 12.

The angularity control 150 and the tension guide 156 cooperate to insure that the cloth is deposited on the conveyor uniformly and at a predetermined tension. The angularity control 150 monitors the angle of incidence the cloth makes with the cutting surface and is operative to modify the cloth feed roll speed to compensate for changes in the incident angle.

Figure 11A:
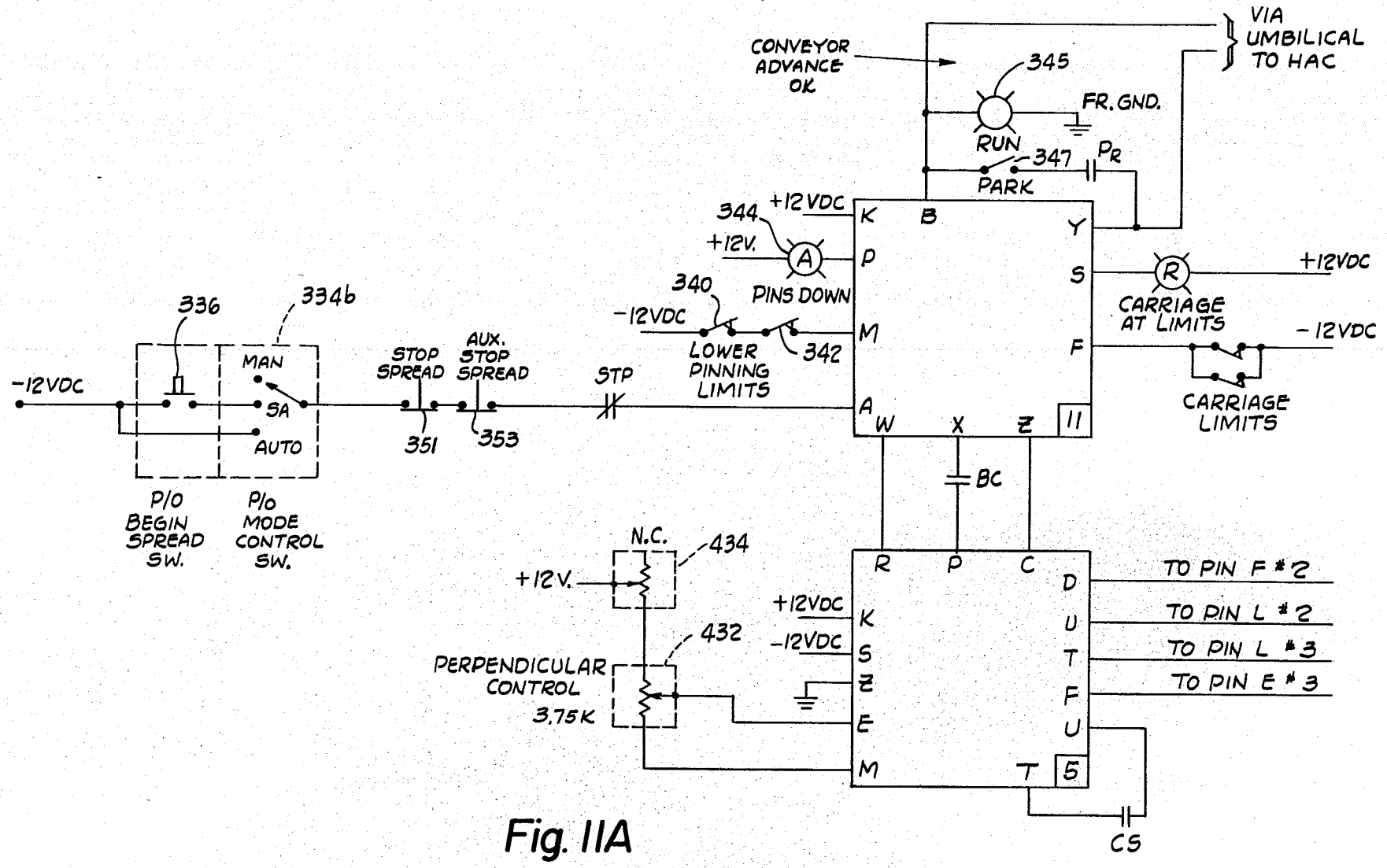

As seen in FIGS. 3, 4 and 5, the angularity control comprises a housing 150*a* that is mounted to the carriage frame 50 by a bracket 151 and encloses a low torque potentiometer (shown as part of the electronic circuitry in FIG. 11*a*). An actuating arm 152 is attached to the shaft of the potentiometer and extends into the web path. The potentiometer is preferably a low torque variety so that very little force is necessary to effect movement. The arm 152 has a rather large extent and establishes a large moment arm to further minimize the force necessary to effect movement. It should thus be apparent, that the angularity control will add little if any tension to the web 39*a* as it descends to the cutting surface 12.

FIG. 3, a illustrates the web path and the geometry between the web 39*a* and the angularity control 150. As shown, the cloth web descends downwardly from the feed roll 40 and passes between the angularity control 150 and the articulated tension guide or barrier 156 before impinging on the cutting surface 12. The angle X defined by the cloth with the cutting surface 12 will determine the tension at which the cloth is laid on the surface 12. When the angle of incidence is substantially 90° (as shown in FIG. 3), the cloth will be deposited substantially tension free, for only a gravitational force is exerted on the cloth and this imparts very little tension. As the incidence angles become more acute, tension will be imparted to the cloth in proportion to the angle form.

The tension guide or barrier 156 serves a two fold purpose and, as seen in FIGS. 5 and 6, comprises a plurality of vertically aligned and horizontally extending rods 158. The rods are suspended from the spreader support housing by a pair of chains 160 to form an articulated assembly. One purpose for the guide 156 is to detect excessive tension in the web and it does so in connection with a switch 160 mounted just ahead of the guide 156 (shown best in FIGS. 1 and 3). Excessive tension in the web will be manifested as a very acute angle of incidence. Should this occur, the web 39*a* will contact the guide 156 and move it to the left as viewed in FIG. 3 and if moved far enough will cause the lower rod 158 to contact the switch arm 160*a* of the switch 160. The switch 160 is part of the spreader drive control circuit and is operative to interrupt power to the spreader drive motor upon actuation by the tension guide 156.

Figure 6A:
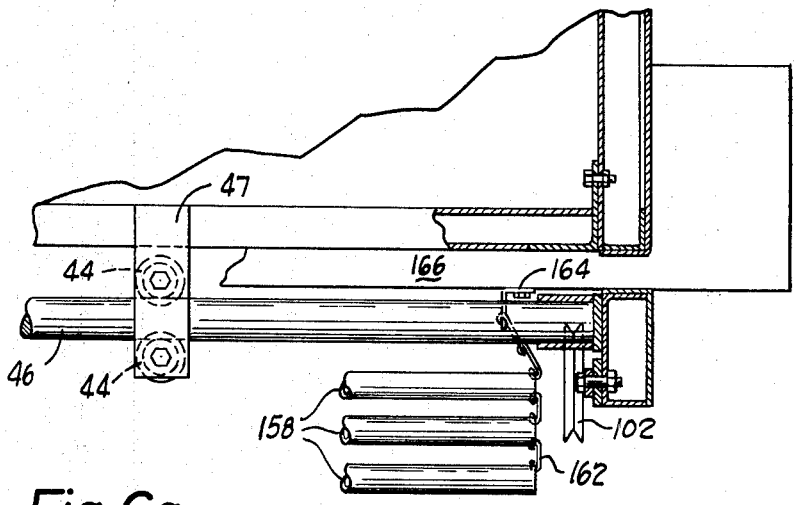
FIG. 6A is a fragmentary view of a portion of the cloth feed carriage as seen along the line 6A—6A in FIG. 6.

When desired, the tension guide 156 can also be used to impart a predetermined amount of tension across the width of the web 39*a* or in some instances, to impart tension to localized areas of the web. As seen in FIG. 6*a*, the individual rods 158 are suspended and attached from each other by a chain link 162 that extends through apertures formed near the ends of the rods 158. The top rod 158 is attached to the spreader by a pair of links 162 which extend between an aperture in the top rod 158 and a bracket 164 attached to a support member 166 of the feed roll carriage. This construction allows the rods 158 to move relative to each other and allows them to conform to and ride against the cloth web 39*a*. This advantageous feature allows an operator to add tension to the web equal to the weight of one or more of the rods 158 by appropriately adjusting the angle of cloth incidence X.

It should be apparent, that as the angle of incidence increases, the distance that the rods 158 move (to the right as viewed in FIG. 3) will also increase thereby increasing the tension placed on the web prior to contacting the cutting surface 12. As explained earlier, the angle of incidence is adjusted and maintained by the angularity control 150. Referring to FIG. 3, the arm 152 of the control 150 will ride against the left side of the web 39*a* whereas the tension guide 156 will ride against the right side of the web. Once the angularity control is adjusted for a given angle of incidence, the associated control circuitry will maintain this angle as the spreader 10 moves along the cutting surface 12. If the angle X is chosen such that the tension guide is moved to the right (as seen in FIGS. 3 and 6), the cloth will be laid upon the conveyor at a predetermined tension. If the angle of incidence is chosen to be substantially 90°, little if any contact will occur between the web and the tension guide 156 and the cloth will be laid upon the conveyor substantially tension free. It should be noted, however, that gravity itself will add some tension to the cloth but it is minimal.

The tension guide 156 can be used not only to impart tension across the entire width of the web, but can also be used to add tension to localized areas on the web. In instances where cloth of non-uniform tension is being spread, the angularity control 150 can be adjusted so that only certain areas of the web contact the tension guide 156. For example, should the edges of the web have greater tension than the center portions, the angularity control 150 is adjusted so that only the edges contact the tension guide 156. The guide 156 will then stretch or restrain the edges of the web so that wrinkling is prevented in the center web portions. Absent this feature, the cloth would be laid on the conveyor 12 nonuniformly and if the fabric is patterned, skewing and nonlinearity across the width of the web would be exhibited.

In the prefered embodiment of the invention, the spreader 10 is adapted to be operated with a chain driven movable conveyor forming part of an automatic laser cutting system. In operation, the spreader 10 spreads a layer of cloth on the conveyor 12 during a cutting cycle in which previously spread cloth is cut into individual garment pieces at a cutting station. As discussed earlier, prior spreaders deposited cloth on the conveyor as it moved towards the cutting station. Because this occurred at a relatively high speed, inconsistent cloth spreading and fabric stretching often occurred due to a speed mismatched between the cloth spreader and the conveyor.

The present invention contemplates a different method of operating a spreader with an automatic cutting system and instead spreads cloth during the cutting cycle when the conveyor is stationary. In order to advance the spreader 10 to a starting spread position, the spreader includes apparatus for coupling the spreader to the conveyor so that it moves along with the conveyor as it advances toward the cutting station. Referring to FIGS. 3, 6 and 8, the coupling apparatus comprises a pin arrangement 180 attached to the spreader support housing 20 which is adapted to engage the conveyor chain drive 14 so that movement in the chain 14 will cause corresponding movement in the spreader 10. FIG. 8 illustrates the detail of the pinning arrangement. It includes a vertically disposed actuating rod 182 slidably supported by bushings 184, 186 mounted in a housing 188. The rod 182 includes a threaded axial hole 190 at its lower end which accepts a break pin 192. The threaded coupling between the pin 192 and the rod 190 allows for some vertical adjustment between the members. A jam nut 193 locks the position of the pin 192 in the rod 182. The pin 192 is designed to shear off if the spreader 10 advances beyond its starting position due to a malfunction in the pin retracting mechanism or control. A horizontal pin 194 is attached to the rod 182 and extends through a slot 196 formed in the housing 188. An actuator 198 preferably pneumatically operated, engages the horizontal pin 194 and is operative to effect vertical movement in the rod 182 towards and away from the chain 14. The actuator 198 is suspended from a frame member of the spreader support housing 20 and is attached to an eyelet bracket 202 by a bolt 204. The application of pneumatic pressure to the extension retraction chambers (not shown) in the actuator 198 is controlled by a conventional solenoid controlled valve (not shown), the energization of which is effected by the spreader control circuitry shown in FIG. 10.

In the preferred embodiment the solenoid valve is a four-way valve, which when deenergized communicates air pressure to the retract chambers of the actuators 198 while concurrently exhausting the air pressure from the extension chambers of the actuators. When the solenoid is energized, the valve communicates air pressure to the extension chambers and exhausts the pressure in the retract chambers of the actuators 198.

As seen in FIG. 8, the chain 14 that drives the conveyor 12 rides atop a chain support 206. To couple the spreader 10 to the chain 14, the rod 182 is driven downwardly by the actuator 198 so that the pin 192 enters the space between two adjacent rollers in the chain. The pin 192 is sized to provide adequate clearance between the adjacent rollers so that should the pin contact the top of the roller in its downward travel, the pin will slide off the roller, moving the spreader slightly, to align itself with the spacing between adjacent rollers. Consequently, sensing of the chain link position is unnecessary because during pin engagement, the spreader will move slightly to align the pin and the chain link.

In operation, the actuating rods 182 are driven downwardly by the actuators 198 so that the pins 192 engage the drive chains 14 on either side of the conveyor 12. This occurs prior to conveyor advancement. As will be explained later, once the pins 192 have seated properly, the spreader control circuitry allows the conveyor 12 to move towards the cutting station (not shown), pulling the spreader 10 along with it.

The position of the actuating rod 182 is monitored by a "pin up" limit switch 212 and a "pin down" limit switch 214, fastened to a support member 215. The switches 212,214 are operated by an actuating arm 216 attached to the actuator (198) extension arm and include switch contacts 346,340, respectively. In the preferred embodiment, a pin apparatus 180 is used on either side of the spreader housing 20. (See FIG. 5). The other pin apparatus 180 includes its own "up" and "down" limit switches 212,214 having switch contacts 348,342, respectively.

After the conveyor 12 stops, air pressure is communicated to the actuators 198 to retract the actuating rods and pins 182, 192 thereby decoupling the spreader 10 from the conveyor 12. The clutch 122 and the spreader drive motor 116 are then energized to rotate the spreader drive wheels 104 and cause the spreader to return to its original position at the end of the conveyor, depositing a layer of cloth to be cut as it travels over the conveyor/cutting surface 12.

Referring to FIG. 3, a travel limit switch assembly 220 is mounted to the back of the spreader housing 20 and is actuated when the spreader 10 reaches the end of the conveyor. In the preferred embodiment, the assembly 220 includes at least two switches, 222, 224 mounted side-by-side, each having a downwardly extending plunger 226 and a roller 228. Switch 222 is shown in FIG. 2 and is designated as the spreader stop limit switch. Actuation of this switch should deenergize the spreader drive system. The switch 224 is shown in FIG. 3 and is designated as an overtravel limit switch and is actuated should the spreader stop switch 222 fail to stop the spreader at the end of the conveyor. The roller 228 is not shown for the switch 224 but is substantially identical to the roller 224 shown in FIG. 2 for switch 222.

The switches 222, 224 include switch contacts 338, 333 respectively, (shown as part of the control circuitry in FIG. 10), which are operated by the respective plungers 226. The plungers and associated rollers 226, 228 are actuated by cam surfaces mounted at the end of the conveyor. A cam surface 230 for the switch 222 is shown in FIG. 3. A similar cam surface (not shown) is positioned adjacent to and to the right of the cam surface 230 so that the switch 224 will be actuated if the spreader moves too far to the right as viewed in FIG. 3 as a result of a failure in the switch 222 or the associated circuitry.

Control circuitry located inside the spreader housing coordinates the spreader movement with cloth deposition onto the conveyor 12. An operator control panel 310 is located on one side of the spreader and includes a plurality of switches and indicator lights coupled to the control circuitry to allow the operator to monitor and control spreader operation.

Figure 9:
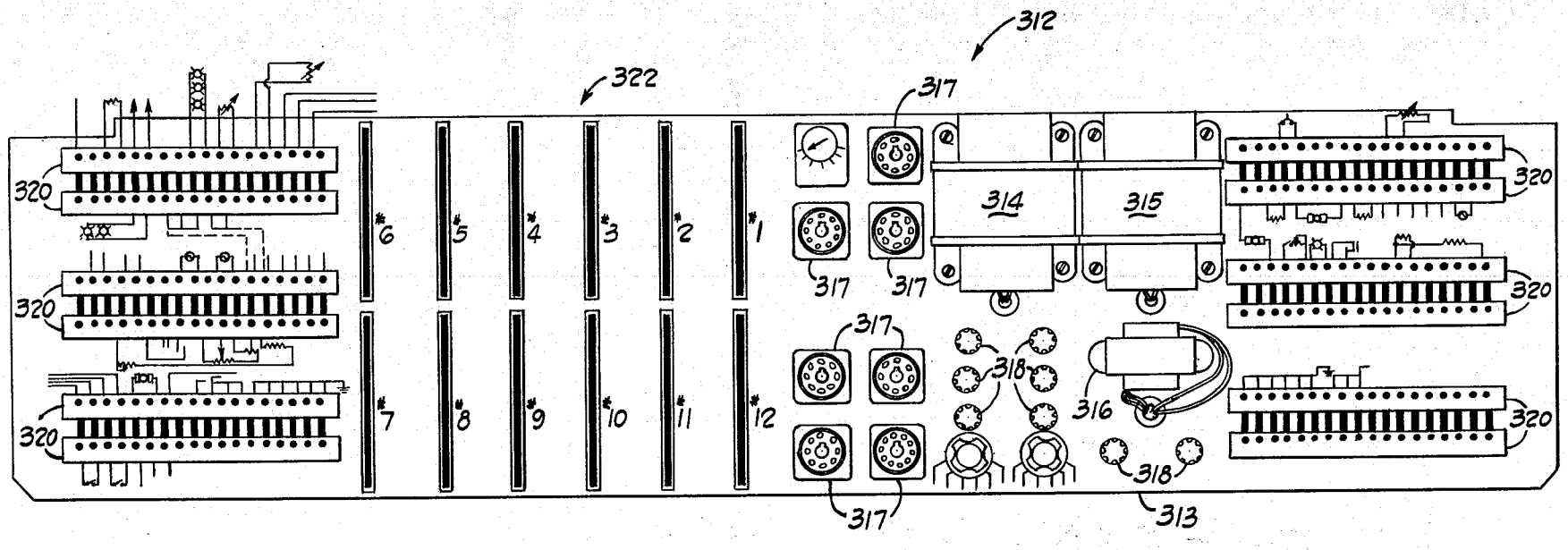
FIG. 9 illustrates a back panel plate for mounting electronic components and control circuitry.
Figure 9A:
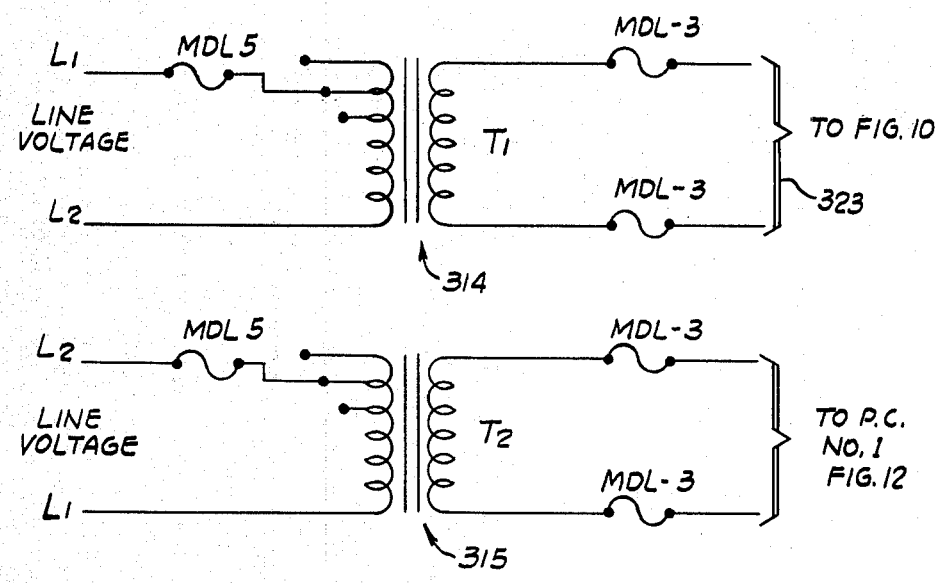
FIG. 9*a* is a schematic of a portion of the control circuitry mounted to the back panel plate illustrated in FIG. 9; and, FIGS. 9*a*–17 are schematics for control circuitry that control spreader movement and cloth feed.

Turning now to FIG. 9 a schematic of an electrical panel 312 is illustrated. This panel 312 is mounted at the rear of the spreader and supports the control circuitry which is coupled to the control panel 310. The panel 312 comprises a back plate 313 which supports three transformers 314, 315, 316 (the line inputs to two of which are shown in FIG. 9*a*), a number of relays 317, fuses 318, interconnection points shown collectively as terminal blocks 320, and a plurality of printed circuit cards 322 which are labeled beginning at printed circuit card No. 1 and ending in printed circuit card No. 12.

Figure 10:
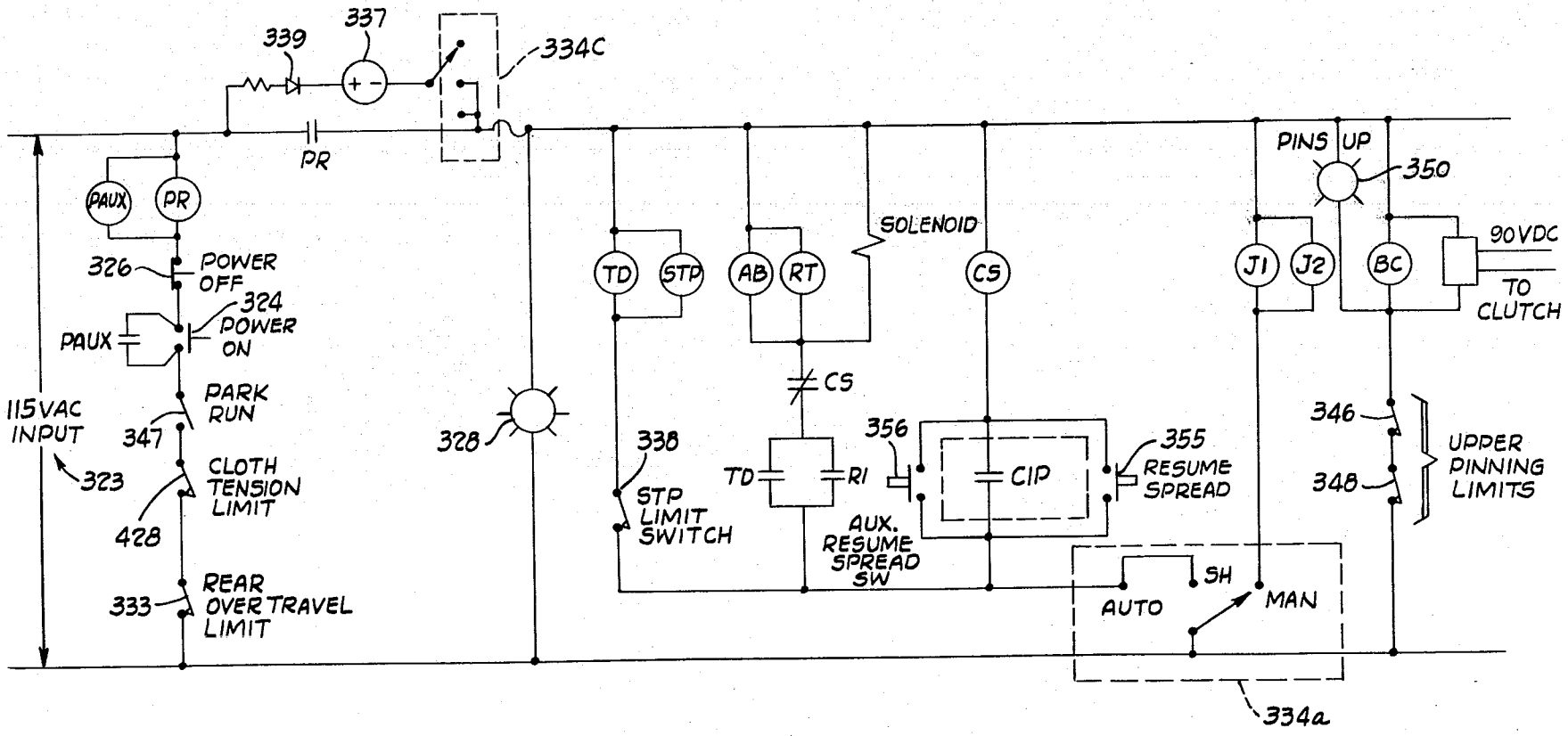
Figure 11B:
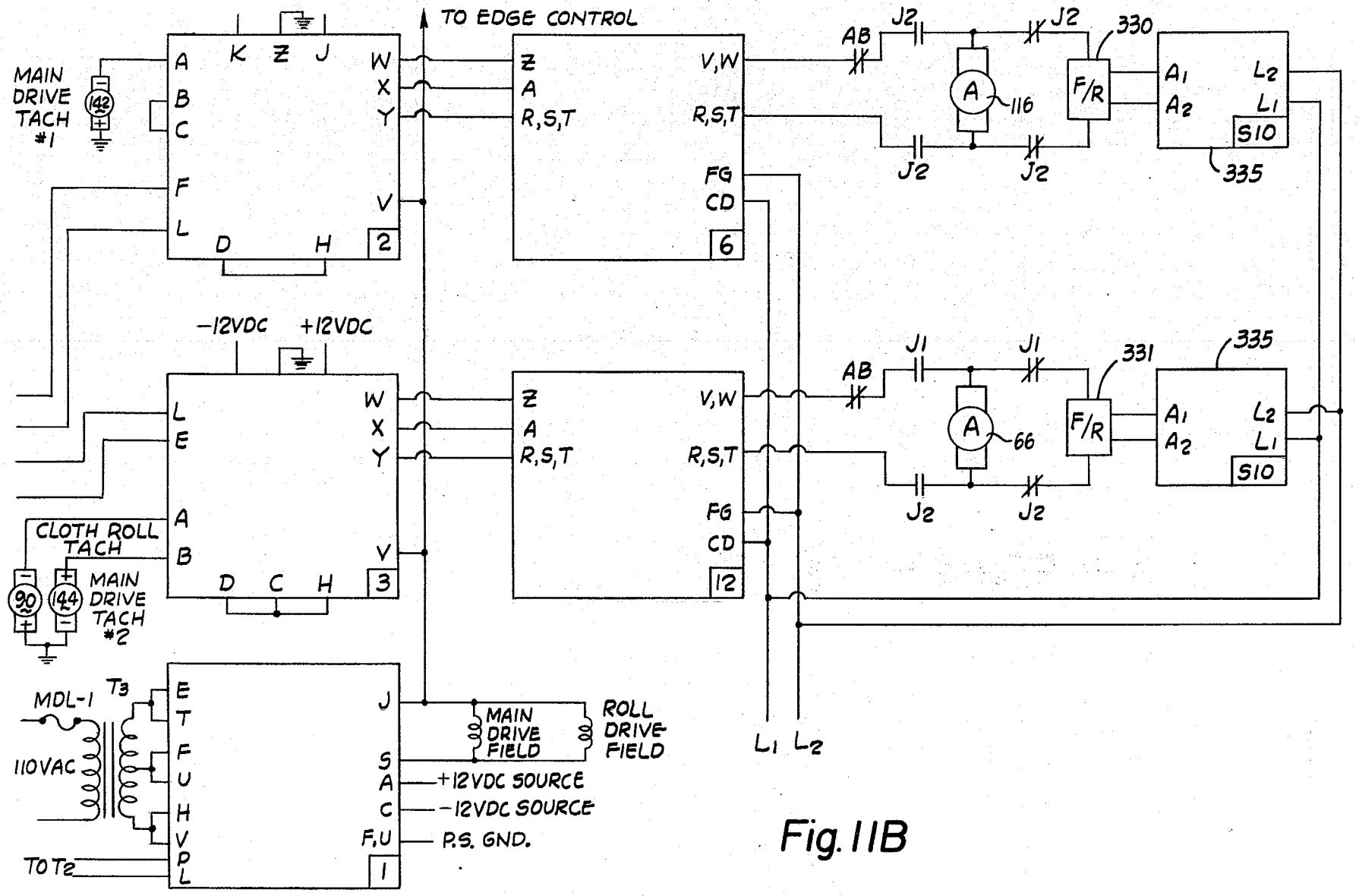

Much of the control circuitry mounted to the back plate 313 is conventional and commercially available from Cutters Exchange, Inc. The novel and unique features of the present spreader 14, however, have necessitated that some of the circuitry be modified and supplemented. These modifications and additions will be described in depth and where the circuit is unmodified and conventional its function will be described without in depth description of the individual components therein. FIGS. 10, 11A and 11B schematically show the interconnection of printed circuit cards No. 1, 2, 3, 5, 6, 11, and 12 with the relays 317. The remaining printed circuit boards (4, 7–10) include components which are conventional and control the cloth cutter and the carriage drive motor 54. These circuits are commercially avaiable from Cutters Exchange, Inc.

Figure 12:
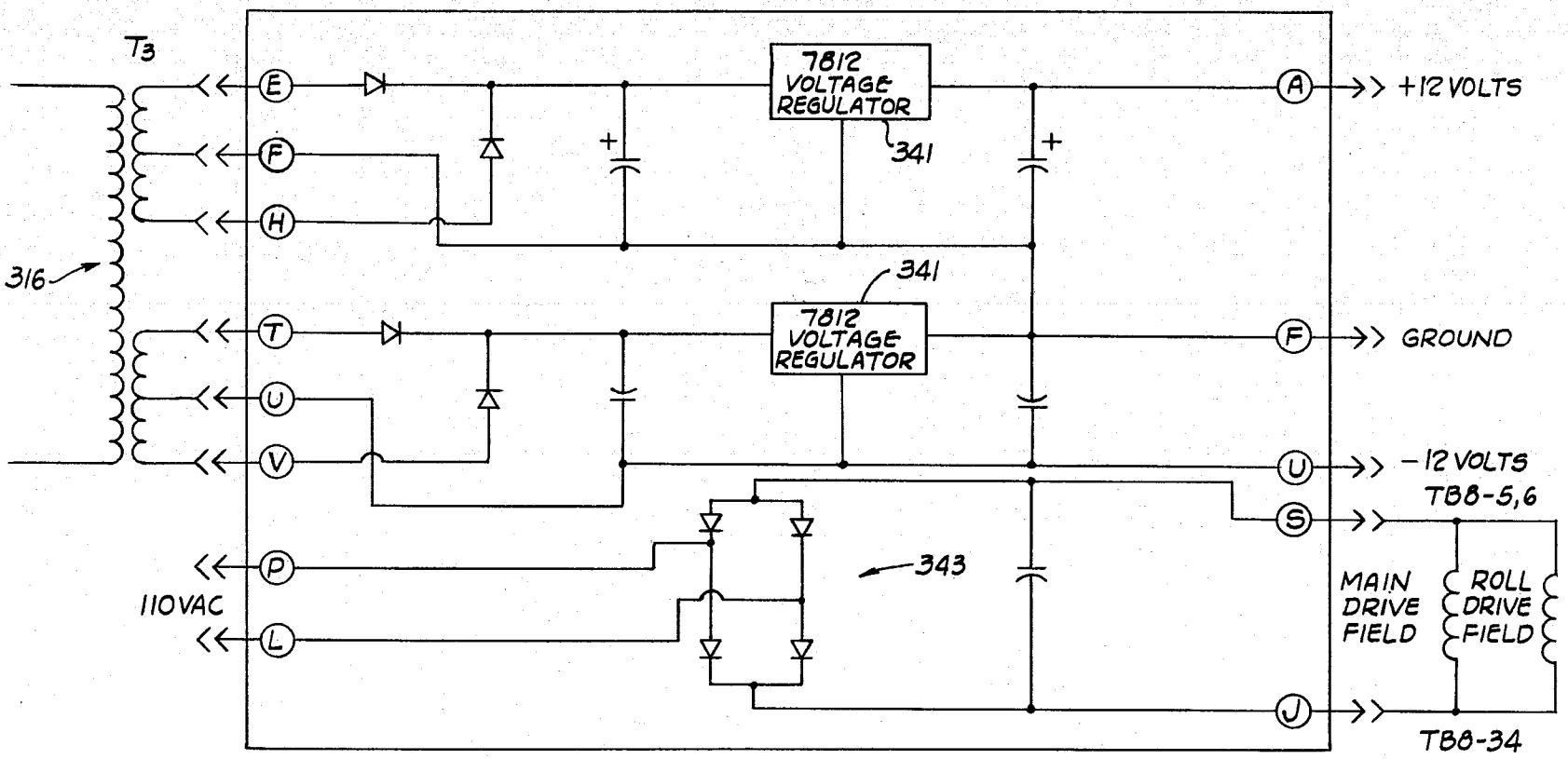

Power is transmitted to the control circuitry from a 115 volt alternating current input 323 and from a regulated power supply on printed circuit card No. 1 (FIG. 12). When a power-on switch 324 is activated, the 115 volt alternating current source energizes a relay PR. Energization of this relay PR causes a contact PR to close thereby transmitting 115 volts alternating current to the remaining portions of the control circuitry as shown in FIG. 10. When relay PR is energized, a second relay Paux is also energized closing a contact Paux which latches the power-on switch. Activation of a power-off switch 326 de-energizes the relay PR thereby opening the contacts PR and deenergizing the circuitry shown in FIG. 10.

In the preferred embodiment of the invention the power-on 324 and off 326 switches are located on an upper left surface of the control panel 310 and are slightly larger than the other panel switches. When the power-on switch 324 has been activated a power-on indicator light 328 is energized showing that the control circuitry has been coupled to the 115 volt alternating current source.

There are three modes of spreader operation. In two of these modes known as an automatic and a semiautomatic mode, the spreader movement is sensed and modifications in movement made to provide proper cloth deposition onto the conveyor. In a third mode known as the manual mode, the operator directly controls spreader movement by activation of three toggle switches 330, 331, 332 labeled manual jog controls in FIG. 2.

The three toggle switches are coupled to the DC motors mounted in the spreader 10 only when a mode selector switch 334 is in a manual position. The switch 334 comprises a ganged series of 3 three-position switches 334*a*, 334*b*, 334*c*. When a first of these ganged switches 334*a* is in a manual position, 2 relays J1, J2 are energized. This energization closes two contacts J1, J2 connected to the 3 toggle switches 330, 331, 332. The toggle switches are in turn connected to a DC speed control 335. Only the DC speed control to the spreader drive motor 116 and the cloth feed motor 66 are shown in FIG. 11B. The DC speed control to the carriage drive motor 54 although not shown, is similar. The two speed controls 335 are adjustable and can be set for a particular motor speed as desired.

In a preferred and disclosed embodiment these 2 speed controls connected to the spreader drive and cloth feed motors 116, 66 (shown in FIGS. 2 and 3) are supplied by Dayton Electric Company and the speed control for the edge guide motor is supplied by Seco. The only difference between the 2 speed controls is that the Dayton Electric provides half-wave rectified outputs while the Seco speed control provides a full wave rectified output. By toggling the switches 330, 331, 332 from a forward to reverse position and spreader drive, cloth feed, and carriage drive motors 116, 66, 54 can be positioned as desired by the spreader operator.

A second switch 334*b* in the ganged array of switches transmits power to the circuitry shown in FIG. 11A. When this switch is set in the manual mode it can be seen that it functions to disable this circuitry and the speed and direction of motor movement is controlled by the toggle switches. When in either the semiautomatic or automatic position, the switch 334*b* couples a minus 12 volt DC source to the circuitry shown in FIGS. 11A and 11B. In particular this signal is transmitted to pin A on printed circuit card No. 11. Intermediate the minus 12 volt DC source and the switch 334*b* is a semiautomatic pushbutton control switch 336 which also selectively couples the circuitry to the minus 12 volt source.

A third switch 334*c* couples the circuitry in FIG. 10 to an alarm 337. When the switch 334*c* is in either the semiautomatic or automatic mode inadvertent opening of the contact TR causes current to pass through a diode 339 which sets off the alarm 337. Thus, if the contact TR should for any reason open when the spreader is set in either the automatic or semiautomatic mode an alarm will indicate that the control circuitry has been de-energized.

At the bottom of FIG. 11B is located a first printed circuit card (FIG. 12) which includes two voltage regulators 341 and a rectifying circuit 343. This printed circuit card is connected to transformer 316 and 110 VAC line voltage and serves two purposes. It generates a 110 volt full wave rectified signal to drive the field windings in the spreader drive and cloth feed motors 116, 66, respectively (see FIGS. 2 and 4). It also generates a positive and negative 12 volt DC regulated signal used to energize the remaining printed circuit cards. The circuitry on printed circuit card No. 1 is conventional and may be obtained for example, from Cutters Exchange, Inc.

The following presents a chronological sequence of events occurring when the relay PR is energized by activation of the power-on switch 324. It is assumed in this discussion that the mode selector switch is in either the semiautomatic or automatic mode and it is further assumed that the spreader is contacting a travel limit switch contact 338, forming a part of the travel limit switch shown in FIG. 2, so that a relay TD is energized when the power-on switch is closed. If the spreader 10 is not at the end of travel position where the switch 220 is activated, the system must be operated in a manual mode to position the spreader at the end of its travel so the switch contact 338 is closed, thereby energizing relay TD.

An overtravel limit switch contact 333, forming part of the overtravel limit switch 224 shown in FIG. 3, is also closed. This switch contact 333 is an emergency switch and indicates the spreader has passed the firs travel limit switch 222 (housing the switch contacts 338). Opening of this overtravel limit switch deenergizes the circuitry and all movement stops.

With the switch contact 338 closed, a time delay relay TD is energized. The contact TD closes approximately one second after the relay TD is energized which in turn energizes relay R1. Relay R1 closes a second contact R1 which serves to latch the relay R1 in an energized state. A relay STP is also energized so long as the limit switch contact 338 is closed and this serves to open a contact STP shown in FIG. 11A. Thus, so long as the travel switch is closed Pin A on printed cirucit card No. 11 is deenergized and disconnected from the minus 12 volts DC power.

Closing of the contacts TD and R1 energizes a relay AB and also energizes a solenoid controlled air valve causing the pins to be driven into the conveyor thereby coupling the spreader to the conveyor. The relay AB opens two contacts AB located in FIG. 11B thereby breaking all armature current in the drive and feed cloth motors. Again it should be appreciated that a similar contact AB is coupled to the edge guide motor and similarly breaks armature current in that motor. At this juncture the spreader has been coupled to the conveyor and the spreader is ready for movement with the conveyor toward the cloth cutting station.

Figure 14:
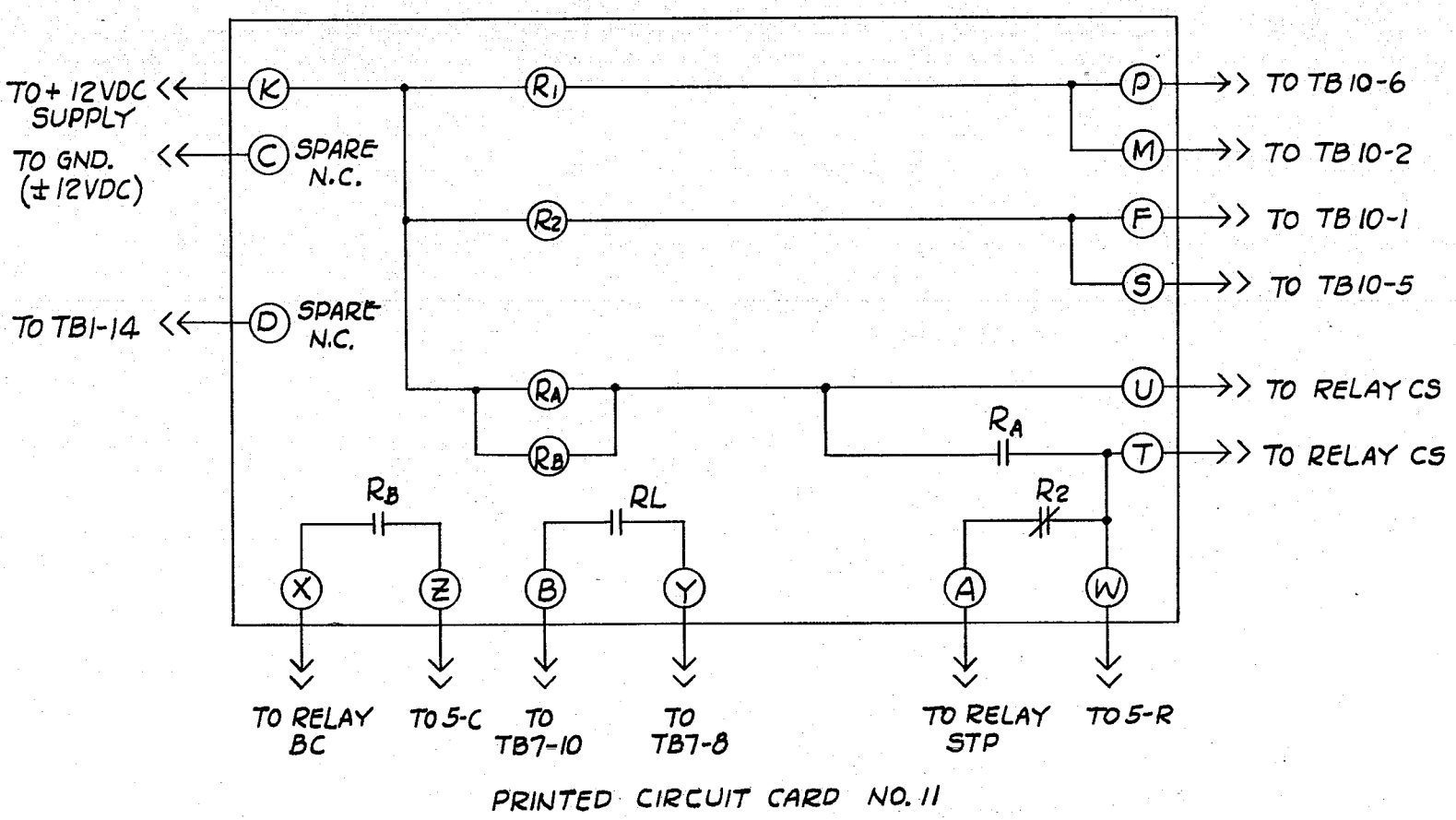

Once the pins have seated and the spreader and conveyor are coupled for combined movement, a signal is transmitted to the conveyor circuitry (not shown) causing the conveyor to advance both conveyor and spreader. The generation of this signal is best understood by referring to FIGS. 11A and 14. FIG. 14 shows the layout of printed circuit card No. 11. When the pins have been driven toward the conveyor and coupled the conveyor to the spreader, two lower pinning limit switches 340, 342 are closed. As seen in FIG. 11A this condition couples a positive and negative 12 volt DC source across an indicator light 344 appearing on the operator control panel 310. By referring to FIG. 14 it is also apparent that the closure of these two switches 340 also energizesa relay RL which in turn closes a contact RL. This closes a circuit on the conveyor control causing the conveyor to advance the spreader to an initial cloth laying position and energizes a conveyor advance indicator 345 labeled "CONVEYOR ADVANCE OK" in FIG. 11A.

The contact RL can be bypassed by closing a park switch 347. If the relay PR is deenergized (indicating the spreader control circuitry has been deenergized) closing the park switch 347 completes the same circuit closed by contact RL thereby indicating the conveyor can advance. In this way the conveyor can be operated without moving the spreader 10.

The conveyor is coupled to an optical encoder which generates signals indicating extent of travel. When an appropriate length has been traversed by the conveyor a signal is generated which energizes a relay within the conveyor control circuitry which in turn momentarily closes a contact labeled CIP in FIG. 10. The closure of this contact CIP energizes a relay CS which opens a contact CS seen in FIG. 10. By opening this circuit relays AB, R1 are deenergized which results in the closing of contact AB coupled to the motor armature circuits and the opening of contact R1 in FIG. 10. The opening of contact CS also deenergizes the solenoid controlled air valve which decouples the spreader from the conveyor. When the pins and activating rods 192, 182 (shown in FIG. 8) retract and disengage the conveyor, they cause two "pins up" limit switches 346, 348 to close thereby energizing a relay BC and causing an indicator light 350 on the control panel 310 to indicate the pins have been decoupled from the conveyor. The closing of these two switches 345, 348 also causes a clutch coupled to the drive motor to engage thereby enabling that motor to cause movement in the spreader.

Figure 13:
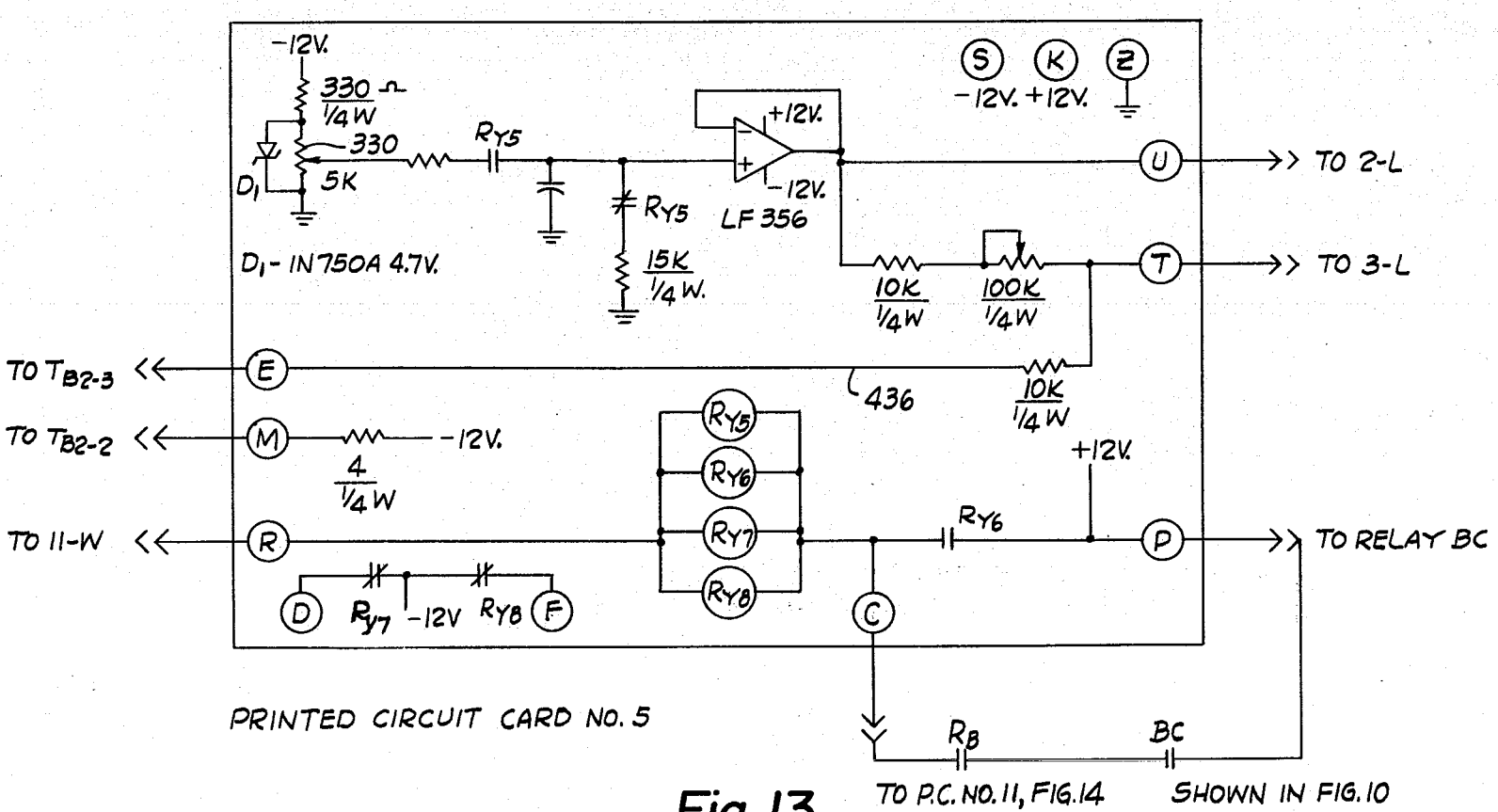

A contact BC is coupled between pins P and C on printed circuit card No. 5 (see FIG. 13). Also coupled between pins P and C is a second contact RB which was closed when a relay RB was energized in response to the closing of the contact CS. Once contacts RB and BC close (contacts BC closed when the pin limit switches 346, 348 closed) relays RY5, RY6, RY7 and RY8are energized (see FIG. 5). The energization of relay RY6 causes latching contact RY6 to close. Energization of relays RY7 and RY8 open two contacts RY7 and RY8. The opening of these contacts disconnects the minus 12 volt supply from output pins D and F on printed circuit card No. 5. These pins are coupled to input pins F and E on printed circuit cards Nos. 2 and 3 respectively. (see FIG. 11A). The removal of this minus 12 volt signal from printed circuit cards Nos. 2 and 3 combined with the generation of a reference input 352 at input pin L on cards 2 and 3 initiates movement of the spreader along the conveyor. The reference input is generated on card No. 5 by a unity gain op amp in response to the closing of contact RY5. Movement continues until the contact limit switch 338 at the end of the conveyor is again reached energizing relays TD and STP. When the relay STP is energized contact STP is opened and spreader movement is terminated.

Two stop spread pushbutton switches 351, 353 (see FIG. 11A) can be activated to stop spreader movement in either the automatic or semi-automatic mode. One switch 351 is located on the operator control panel 310 and the second is located on an opposed side of the spreader 14. These switches serve the same function as relay STP since activation of either switch terminates power transmittal to Pin A on card No. 11. This power disruption deenergizes relay RY5, RY6, RY7, and RY8 which in turn stops spreader motion. These relays RY5, RY6, TY7, and RY8 remain deenergized when the pushbutton (351 or 353) is released since contact RY6 is now opened.

To re-initiate spreader movement the operation can activate one of two spread resume pushbutton switches 355, 356. One switch 355 is mounted on the panel 310 and the second 356 is on the opposed spreader side. If either switch 355, 356 is activated and the "pins up" limit switches, 346, 348 are closed spreader movement is initiated since contact CS (FIG. 10) closes, energizing relay RB which in turn closes contact RB (FIG. 14) reenergizing relays RY5, RY6, RY7, and RY8.

Figure 15:
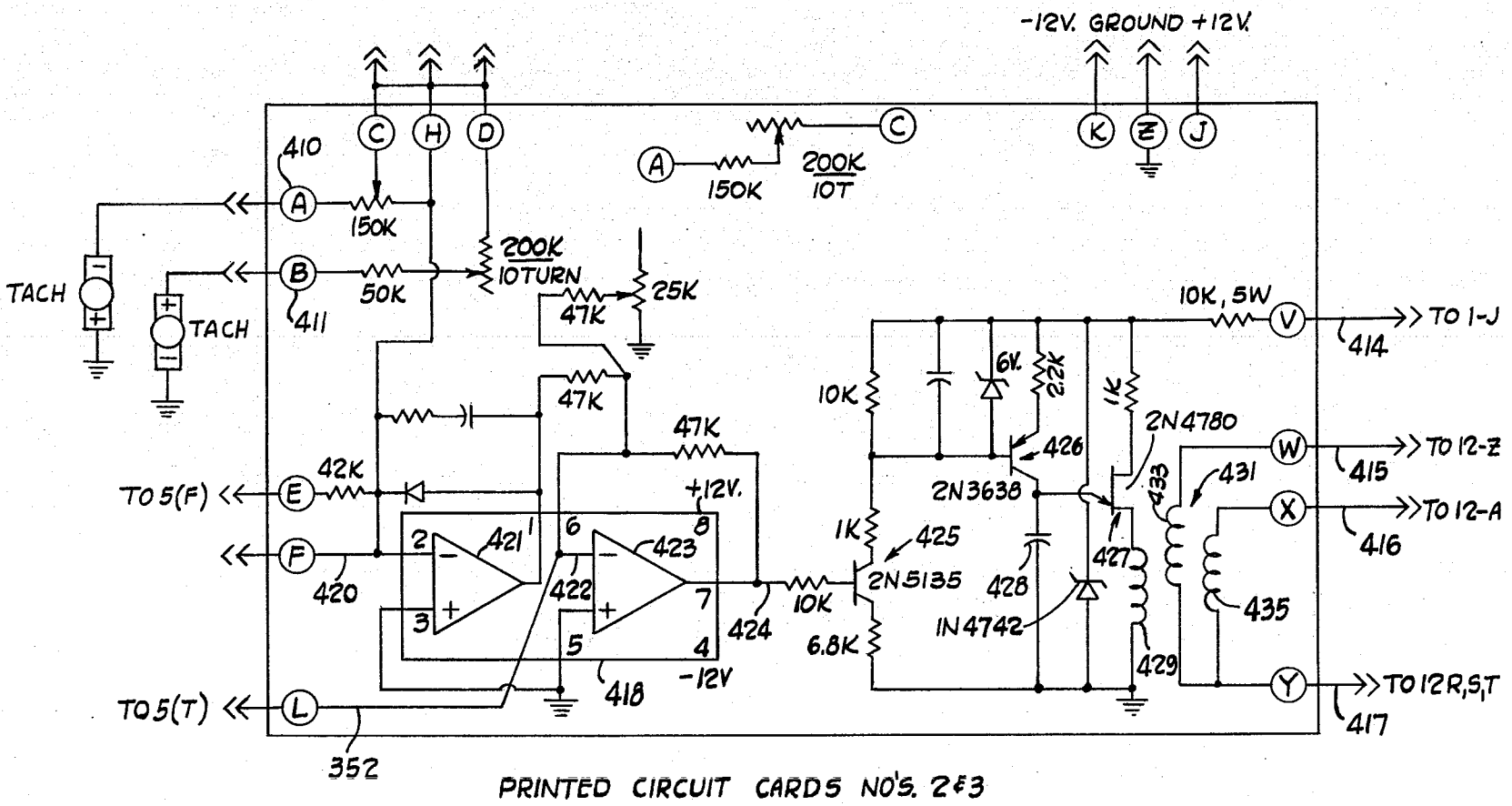

Three printed circuit cards (No. 2, No. 3, and No. 5) include circuitry (see FIGS. 13 and 15) which monitors and controls the speed of both the spreader and cloth feed roll by controlling the power fed to the two direct current motor's armature circuits. The circuitry on printed circuit cards 2 and 3 is identical so FIG. 15 represents both printed circuit cards. While much of this circuitry is again commercially available and conventional the design of the present spreader has necessitated certain circuit modifications which will be described in detail.

Card No. 2 shows circuity for controlling the speed of a drive motor 116. The card includes two tachometer inputs 410, 411, a reference input 352 which is generated on card No. 5 and will be discussed in depth hereinafter and a plurality of outputs 414–417 which control the firing of SCR gates which in turn control the transmittal of power to the drive motor. Mounted to both printed circuit cards No. 2 and No. 3 is a dual compensated op amp 418 which comprises a two-stage amplifier. In the preferred and disclosed embodiment a Motorola MC 1458 is used.

In the disclosed and preferred embodiment of the invention only one tachometer input 410 is utilized on card No. 2. This input is connected to a tachometer 142 which monitors the speed of the drive motor. This signal represents a negative analog signal proportional to the speed of the drive motor and is transmitted to an input 420 coupled to a first amplifier stage 421. The analog signal from the tach is a negative going signal with respect to ground and is inverted to a positive signal by the first amplifier stage 421 and transmitted to an input 422 connected to a second amplifier 423. A second signal to this input 422 comes from card No. 5 and represents a constant magnitude negative signal which can be adjusted by the user. An output 424 from the second amplifier is a positive signal whose magnitude controls the biasing of a first transistor 425. The current flow through this first transistor in turn modifies the electrical potential appearing at the base input to a second transistor 426. Modification of this base input on the second transistor in turn controls the current through this second transistor.

Coupled to the collector of the second transistor is a unijunction transistor 427 which serves as an oscillator. Coupled to the emitter of the second transistor is a 22 kilo ohm resistor which in combination with a capacitor 428 forms a charging circuit. As the unijunction transistor 427 oscillates the capacitor 428 charges and discharges. Were it not for the second transistor 426, the charge time for this circuit would be a constant but through modification of the potential appearing at the base of the second transistor the charge constant may be altered and thereby the frequency of oscillation of the unijunction transistor 427 modified. Since the output from the dual compensated op amp 418 directly controls the biasing on this second transistor 426, it should therefore be apparent to those skilled in the art that changes in the tachometer input 410 affect the frequency of oscillation of the unijunction 427 transistor. Connected to the unijunction transistor is a primary winding 429 of a transformer 431 which includes two secondary windings 433, 435. These secondary windings in turn are coupled to the gate inputs of two SCR's 437, 438 on printed circuit card No. 6. (See FIG. 16).

The operation of the circuitry on printed circuit card No. 2 is as follows. When the spreader is connected to the conveyor the minus 12 volt input at printed circuit card No. 2 pin F generates a base input to the first transistor 425 of about minus 0.2 volts thereby insuring that it is turned off. When this minus 12 volt input is removed, the reference input 352 turns the transistor 425 on. A desired speed of drive motor movement is selected on card No. 5 by adjusting a potentiometer 430 on that card. This signal in addition to the signal from the tachometer 142 form inputs to the op amp 418 which in turn transmits an output to control oscillation frequency in the unijunction oscillator circuit. If the signal from the tachometer is reduced in magnitude thereby indicating that the drive motor is no longer rotating at an appropriate speed, the frequency of output from the unijunction transistor oscillator circuit is modified to increase the on time of the SCR's 435, 437 and thus the power transmittal to the motor. If the drive motor is driving the spreader too rapidly, the tachometer input 410 will indicate an over speed condition and thereby cause the unijunction transistor oscillator circuit to reduce the oscillating signal frequency to the SCR.

The circuitry for controlling the speed of rotation of the cloth feed drive motor 66 is identical to that shown in FIG. 15. The circuit utilizes both tachometer inputs, 410, 411. One tachometer input 410 comes from a second main drive tachometer 144 which produces an analog signal proportional to drive motor speed of rotation. A second tachometer input signal 411 is generated by a cloth roll tachometer 90 coupled to the feed roll motor to monitor its speed of rotation. If the cloth feed rate is substantially equal to spreader travel speed the output from these tachometers should be equal in magnitude and opposite in polarity and combine to generate no error signal. When this condition exists, absent an incorect orientation of the tension guide 156 the spreader is functioning properly and cloth is deposited upon the conveyor at the same rate at which the spreader is moving over the conveyor.

For illustration purposes it is instructive to examine a situation in which the drive motor is rotating more rapidly than the cloth roller. This condition is sensed by the two tachometers coupled to card No. 3 and causes a positive signal to be input to dual compensated op amp 418. In response to this positive input the op amp 418 generates an input at the base of a first transistor 425 which in turn increases the frequency of oscillation of the unijunction transistor 427. The increased frequency of oscillation for the unijunction transistor generates a more rapid gating signal to transformer coupled SCR's on printed circuit card No. 12 which in turn causes those SCR's to drive the cloth roller at a higher rate of speed. When this greater speed of rotation is achieved, the tachometer coupled to the cloth roll produces a larger analog output (which is positive in polarity) and the error signal tends to be smaller. When the error signal disappears, the frequency of oscillation of the unijunction transistor 427 stabilizes and the cloth roll and drive motor operate at the same speed.

The components mounted to printed circuit card No. 5 (FIG. 13) generate control signals for achieving angularity control as cloth is unrolled. As described above, the angularity control 150 comprises a low torque potentiometer 432 enclosed by a housing 150*a* and activated by an elongate arm 152 attached to the shaft of the potentiometer 432, which extends into the path of the web 39*a*. The potentiometer 432 is in turn coupled to a positive and negative 12 volt source from printed circuit card No. 1. An initial adjustment of the angularity control is achieved through setting a second potentiometer 434. This second potentiometer 434 is coupled to a knob 440 on the operator control panel 310. The operator views the deposition of a portion of a roll and adjusts the relationship of the angularity control to the cloth until he is satisfied that the cloth is being properly transmitted to the conveyor. By rotating the first potentiometer knob 440 he is able to adjust the vertical position of the angularity control until he is satisfied that he has experimentally determined the optimum setting. Once this position has been reached, the output from the potentiometer 432 modifies the rotation of the cloth feed motor to maintain the proper incident angle in the angularity control during cloth deposition.

The cicuitry mounted on printed circuit card No. 5 generates both the reference signal 352 to the drive control on printed circuit card No. 2 and a control signal 436 to maintain the angularity adjustment. The control signal 436 from printed circuit card No. 5 is coupled to input L on printed circuit card No. 3. When the angularity control is oriented at the proper angle for cloth deposition, this signal 436 is zero volts. If however, the angle increases indicating that the cloth is being excessively tensioned, to a negative output is generated from the potentiometer and transmitted directly to input position L on card No. 3. This negative output is input to the second amplifier 423 in the dual compensated op amp 418 on printed circuit card No. 3 and is inverted by that amplifier 423. This larger positive signal at the base of the first transistor 425 causes the unijunction transistor oscillator circuit to produce a greater frequency output which in turn causes the cloth feed motor to rotate more rapidly. This increase in the speed of rotation causes the cloth feed roller to dispense cloth at a more rapid rate causing the cloth incident angle to increase. This increase in angle reduces the output of the potentiometer to zero volts once the optimum angle for the angularity control has been reached.

The cloth tension switch 160 mounted just ahead of the tension guide 156 (see FIG. 3) includes contacts 428 (see FIG. 10) which deactivate all circuitry in a manner identical to the power off switch 326 when the switch 160 is activated by the guide 156. The swtich 160 provides a safety feature should the automatic angularity control fail. It is mounted to the spreader and the switch contacts 428 are opened when the switch arm 160*a* is contacted by the tension guide 156 should the angle between the guide 156 and the vertical become too great and the circuitry does not modify the cloth feed motor speed to compensate.

From the above discussion it should be apparent to one skilled in the art that two techniques are used to control the speed of rotation of the cloth feed roll. If the speed of rotation of the cloth feed varies from the speed of rotation of the main drive an error signal is introduced by the tachometer inputs 410, 411 and the speed of the rotation of the cloth drive is modified. If the angularity control differs from the optimum angular orientation the control signal 436 from printed circuit card No. 5 modifies the speed of rotation of the cloth roll until the optimum orientation is again achieved.

Figure 16:
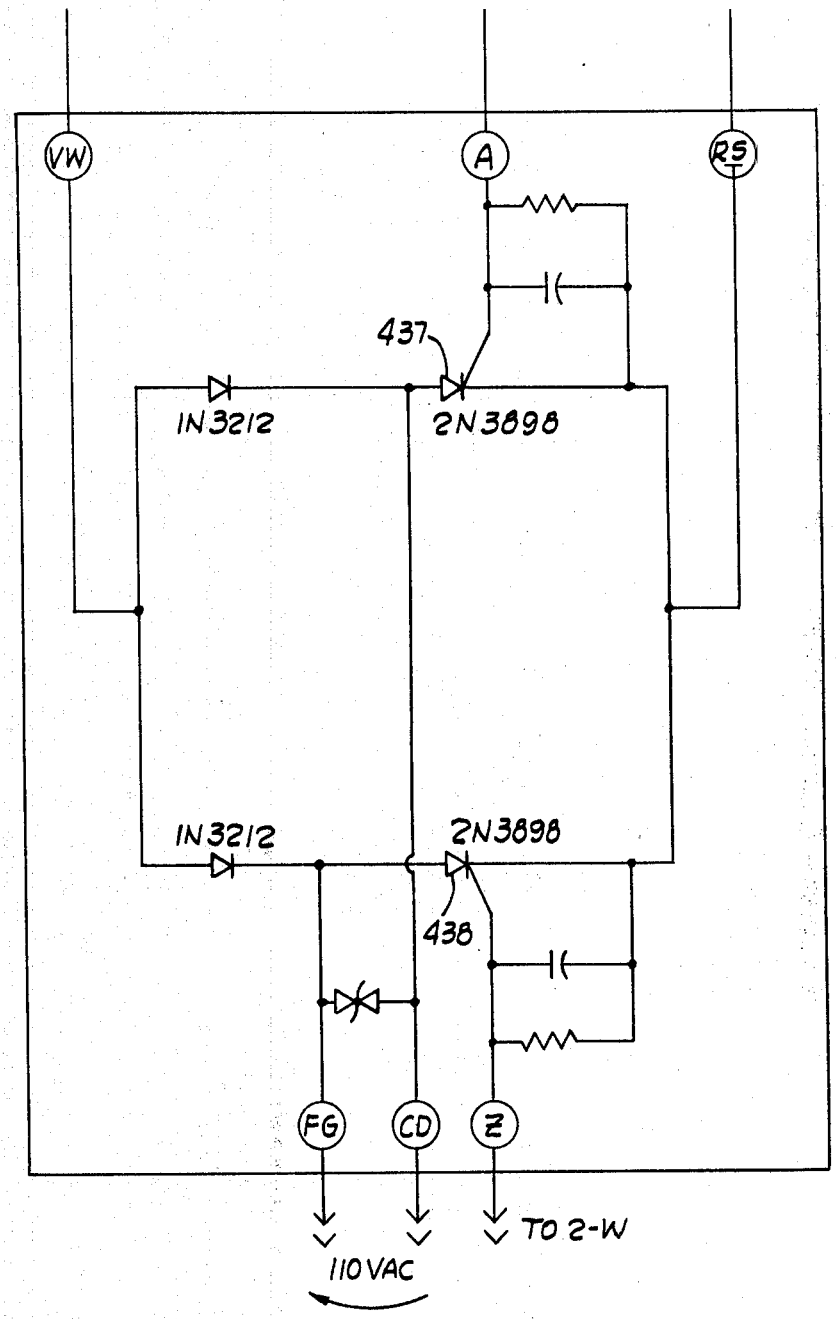

A representative SCR control circuit coupled to the spreader drive DC motor 116 is illustrated in FIG. 16 and is mounted on printed circuit card No. 6. An identical SCR circuit is mounted on printed circuit card No. 12 and is coupled to the cloth feed motor 66. This circuit is coupled to the transformer secondaries 433, 435 in the unijunction oscillator circuit and includes two SCR's, 437, 438 with gate inputs for controlling the power output to the DC drive motor. The longer the time period of SCR's are turned on the greater the power output from a 110 volt alternating current source to the drive motor. By increasing the frequency of the unijunction oscillator circuit the SCR's are turned on for longer time periods causing greater power output to the DC motor.

Figure 17:
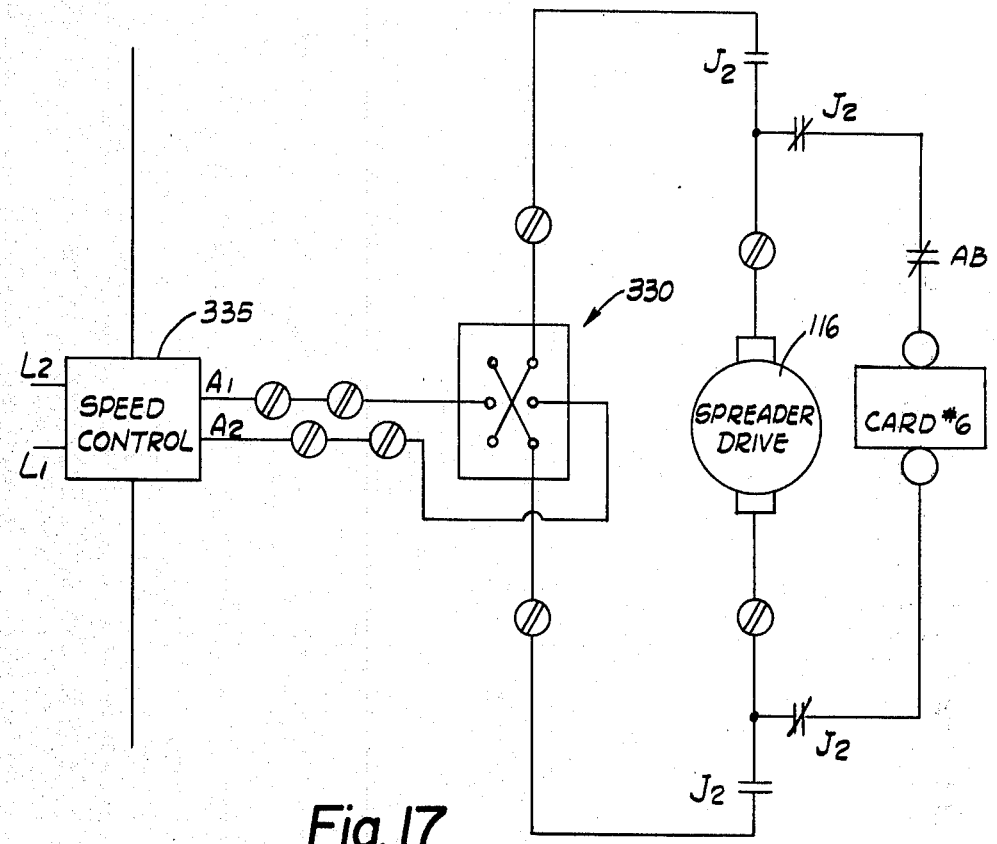

A representative manual control circuit is illustrated in FIG. 17. This circuit includes a double throw double pole toggle switch 330 which can be toggled back and forth by the operator to couple the drive motor 116 to the DC speed control 335 which produces a half wave rectified direct current voltage output and therefore achieves constant speed in spreader motion. By toggling the switch back and forth it is possible for the operator to manually adjust the position of the spreader. Although the circuit illustrated in FIG. 17 is for the spreader drive motor it should be appreciated that an identical manual control circuit exits for the cloth roll drive and the edge control drive motors.

While the preferred embodiment of the invention has been described in considerable detail, it is to be understood that the invention may be otherwise embodied and it is the intention to hereby cover all modifications thereof which come within the scope of the appended claims.

What is claimed is:

1. A cloth spreading apparatus, comprising:

(a) a spreader frame;

(b) a longitudinally moveable cloth laying surface;

(c) spreader drive means for moving said spreader frame longitudinally relative to the laying surface;

(d) a transversely moveable cloth freed carriage mounted to said frame and operative to maintain lateral alignment between the cloth to be laid and said laying surface;

(e) cloth feed drive means for dispensing cloth from said carriage onto said cloth laying surface, said cloth defining an angle of incidence with respect to said laying surface;

(f) feedback means for controlling the speed of the spreader drive means and the cloth feed drive means;

(g) cloth angle detecting means for sensing said angle of incidence of the cloth being laid and operative to control said cloth feed drive means to maintain a predetermined cloth incidence angle when said spreader is laying cloth; and, (h) spreader advancing means including engaging means mounted to said spreader frame, operable to engage said cloth laying surface for advancing said spreader to a predetermined position upon movement in said cloth laying surface.

2. A cloth spreading apparatus, comprising:

(a) a spreader frame;

(b) a cloth laying surface;

(c) spreader drive means for moving said spreader frame relative to the laying surface;

(d) cloth feed carriage mounted to said frame including a cloth feed roll and a drive means for said roll;

(e) a feedback means for controlling the speed of the spreader drive means and the cloth feed drive means;

(f) said cloth feed carriage operative to dispense cloth along a feed path extending between said cloth feed roll and said cloth laying surface, the cloth dispensed by said carriage defining an angle of incidence with respect to said laying surface;

(g) cloth angle sensing means positioned along said cloth feed path and operative to sense the angle of incidence over a continuous range of angles to generate a varying electrical control signal which varies as a function of said cloth incidence angle to indicate a number of different angles of incidence of said cloth; and, (h) angularity control means cooperating with said cloth angle sensing means for maintaining a desired cloth incidence angle.

3. The apparatus of claim 2 wherein said angularity control means is operative to control the cloth feed drive means.

4. The apparatus of claim 2 wherein said cloth laying surface is longitudinally moveable and said apparatus further comprises:

(a) a conveyor means for effecting movement in said cloth laying surface;

(b) conveyor engagement means for selectively interconnecting the spreader frame and said conveyor whereby movement in said cloth laying surface is transmitted to said spreader frame.

5. A cloth spreading apparatus, comprising:

(a) a spreader frame;

(b) a longitudinally moveable cloth laying surface (c) conveyor means for effecting movement in said cloth laying surface;

(d) a longitudinal trackway for guiding and rollingly supporting said spreader frame above the cloth laying surface;

(e) a plurality of track engaging rollers attached to said spreader frame;

(f) spreader drive means for rotating a certain of said rollers thereby effecting relative motion between said spreader frame and said laying surface;

(g) a cloth feed carriage mounted to said frame including a cloth feed roll and a drive means for said roll, for dispensing cloth onto said cloth laying surface, said cloth defining an angle of incidence with respect to said surface;

(h) feedback means for controlling the speed of the spreader drive means and the cloth feed drive means;

(i) angularity control means including cloth angle monitoring means cooperating with said feedback means to maintain a predetermined cloth incidence angle with respect to the cloth laying surface; and (j) conveyor engagement means mounted to said spreader frame for selectively coupling the spreader frame to said conveyor, said engagement when actuated, operative to transmit motion from said conveyor to said spreader frame.

6. A cloth spreading apparatus having a moveable cutting surface for conveying cloth to be cut to a cutting station, comprising:

(a) a spreader frame;

(b) a cloth feed carriage mounted to said spreader frame including a cloth feed drive means for dispensing cloth from said carriage;

(c) track surfaces adjacent said cloth cutting surface;

(d) a plurality of rollers mounted to said spreader frame rollingly engaging said track surfaces;

(e) spreader drive means for moving said spreader frame relative to said cutting surface;

(f) motion transmitting means selectively operative to interconnect said cutting surface of said spreader frame whereby said frame is advanced to a predetermined location upon movement in said cutting surface;

(g) feedback means for controlling the speed of said cloth feed drive means and said spreader frame drive means; and, (h) angularity control means electrically connected to said feedback means and operative to control the speed of said cloth feed drive means thereby maintaining a predetermined cloth dispensing angle relative to said laying surface when said spreader drive means is actuated.

7. In an automatic cloth spreader including a cloth dispensing roll, means for unwinding the cloth from said roll onto a cloth cutting surface, and drive means for moving said spreader in relation to the cloth cutting surface, control circuitry comprising:

(a) first and second sensors for generating first and second control signals related to the speed of unwinding of said roll and the speed of the spreader in relation to said surface respectively;

(b) means including a potentiometer operatively connected to a cloth angularity sensing means, disposed intermediate said roll and said cloth cutting surface for generating a third control signal that is a function of an angle of incidence defined by the cloth with the surface as the cloth unwinds; and (c) comparison means electrically communicated with said first, second and third signals and operative to modify the speed of said drive means and said means for unwinding to maintain said angle substantially constant.

8. The control of claim 7 wherein the means for unwinding includes a cloth feed roll operatively connected to a cloth feed motor and the drive means includes a drive motor operatively connected to a spreader drive wheel and wherein said first and second sensors are responsive to a speed of rotation of the cloth feed motor and a speed of rotation of the drive motor, respectively and the comparison means changes the speed of the cloth feed motor to maintain the angle while equalizing the speed of rotation of said drive and feed motors.

9. The control of claim 8 which further comprises a power circuit in electrical communication to the feed motor and wherein said comparison means includes an output that comprises an input to said power circuit; said input operative to regulate the power output from said feed motor.

10. The control of claim 7 wherein the comparison means comprises:

(a) an operational amplifier with all three signals electrically communicated to one input and wherein an output from said operational amplifier is dependent on the difference between the first and second control signals and further dependent on the deviation between the sensed and desired incidence angle; and, (b) a signal generator with an input electrically communicated to the operational amplifier output and an output electrically communicated to the power circuit to control the power applied to the feed motor and where a frequency of the signal generator output is a function of the operational amplifier output.

* * * * *